US006539579B2

(12) United States Patent
Minami

(10) Patent No.: US 6,539,579 B2
(45) Date of Patent: Apr. 1, 2003

(54) HINGE

(75) Inventor: Saburo Minami, Osaka (JP)

(73) Assignee: Osaka Kanagu Co., Ltd., Osaka (JP)

( * ) Notice: Subject to any disclaimer, the term of this patent is extended or adjusted under 35 U.S.C. 154(b) by 23 days.

(21) Appl. No.: 09/757,656

(22) Filed: Jan. 11, 2001

(65) Prior Publication Data

US 2001/0011405 A1 Aug. 9, 2001

(30) Foreign Application Priority Data

Jan. 11, 2000 (JP) ..... 2000-002443
Dec. 15, 2000 (JP) ..... 2000-381605
Apr. 12, 2000 (JP) ..... 2000-110526

(51) Int. Cl.[7] ..... E05D 7/10

(52) U.S. Cl. ..... 16/229; 16/230; 16/257; 16/258; 16/268; 16/402; 292/228; 292/DIG. 17; 49/36; 49/327

(58) Field of Search ..... 16/176, 229, 230, 16/257, 258, 268, 402; 292/DIG. 17, 228, 341.16; 49/315, 316, 317, 321, 325, 326, 327; 403/12; 414/684.3

(56) References Cited

U.S. PATENT DOCUMENTS 1,302,063 A * 4/1919 Malone ..... 292/179
2,430,942 A * 11/1947 McGiff ..... 16/176
3,143,760 A * 8/1964 Ferguson ..... 16/176
3,786,534 A * 1/1974 Ferguson ..... 16/176
4,185,512 A * 1/1980 Sommer ..... 74/411.5
5,346,266 A * 9/1994 Bisbing ..... 292/64
5,490,305 A * 2/1996 Domingo Ribot ..... 16/229
6,113,160 A * 9/2000 Johansson et al. ..... 292/169

FOREIGN PATENT DOCUMENTS

JP H 1031775 A * 12/1998 ..... E05D/7/081

* cited by examiner

*Primary Examiner*—Anthony Knight
*Assistant Examiner*—Lisa Bannapradist
(74) *Attorney, Agent, or Firm*—Wenderoth, Lind & Ponack, L.L.P.

(57) ABSTRACT

A hinge giving a neat look to a mounting area of a door is not exposed to an outer surface of the door. The hinge has a hinge spindle unit, buried flush with top and bottom lines on a fixed end of the door and disposed so as to allow protrusion and retraction of a spindle, and a hinge body unit, buried at a position facing the hinge spindle unit of the open frame and in which is inserted the protruding spindle, supporting the door to allow it to open and close.

16 Claims, 29 Drawing Sheets

(A)

(B)

HINGE

BACKGROUND OF THE INVENTION

The present invention concerns a hinge, more specifically a hinge giving a neat look to the mounting area of a door without being exposed to the outer surface of the door, facilitating mounting and removal of the door and enabling the door to be opened and closed either inwardly or outwardly.

Conventionally, a door mounted at the entrance of a house or a room is provided with a hinge between the open frame and the door to enable opening and closing of the door. This hinge normally consists of 2 hinge elements fit to each other by means of a single shaft so as to be able to open and close, these hinge elements being fixed to the open frame and the door, respectively, by screws.

The conventional hinge used to be made of such materials as stainless steel, brass, aluminum alloy, etc. and was provided with a coating or plating on the outer surface, as required, and also with various kinds of design in some cases. However, no matter how neatly and gorgeously it may be manufactured, a hinge mounted between the open frame and the door by screws in a place visible from outside the door could not maintain a neat look for the mounting area of the door, and also presented a problem of troublesome work for tightening and loosening set screws for mounting and removing the door.

Moreover, a conventional hinge mounted by being set in advance to open and close the door either inwardly or outwardly, also had a problem of inconvenience of use, because the direction of opening and closing of the door cannot be changed once the door is installed, even in the case where the room could be used more conveniently if the direction of opening and closing of the door is changed after a change in the arrangement of furniture, etc. in the room.

SUMMARY OF THE INVENTION

The objective of the present invention, realized in light of the problems of conventional types of hinges, is to provide a hinge that gives a neat look to the mounting area of a door without being exposed to the outer surface of the door, facilitating mounting and removal of the door and enabling the door to be opened and closed either inwardly or outwardly.

To achieve the objective, the hinge according to the present invention comprises a hinge spindle unit buried flush with the top and bottom lines on the fixed end of the door and disposed in a way to allow protrusion and retraction of the spindle. A hinge body unit is buried at a position facing the hinge spindle unit of the open frame, has the protruding spindle inserted therein, and supports the door so it can both open and close.

The hinge of the present invention is designed to support the door in a way to both open and close it as the protruding and retracting spindle of the hinge spindle unit, buried flush with the top and bottom lines on the fixed end of the door, is inserted in the hinge body unit buried at a position facing the hinge spindle unit of the open frame. It thus becomes possible to give a neat look to the door mounting area without exposing the hinge to the outer surface of the door, and allow the door to be opened and closed either inwardly or outwardly.

Plus, this hinge makes it possible to mount or remove the door in and from the open frame with just a protruding and retracting operation of the spindle, without tightening or loosening set screws as with conventional hinges, and thus facilitates mounting and removal of the door.

The hinge spindle unit can comprise a spindle case body, a spindle inserted in the spindle case body in a way to be locked and protrude and retract under the urging force of a spring, and a stopper holding the spindle in a state retracted in the spindle case body. This makes it possible to not only easily bury the hinge spindle unit in the door, but to also facilitates mounting and removal of the door in and from the open frame, by holding the spindle in a state retracted in the spindle case body with a stopper.

Moreover, the hinge spindle unit can comprise a spindle case body, a spindle inserted in the spindle case body so as to be locked and forming a rack gear biting with a pinion disposed in the spindle case body and capable of protruding and retracting by turning the pinion, and a stopper holding the spindle in a prescribed position. This makes it possible to not only easily bury the hinge spindle unit in the door, but to also facilitates protrusion and retraction of the spindle, facilitates mounting and removal of the door in and from the open frame, and stably mounts the door in the open frame.

Furthermore, the hinge body unit can be comprised of a hinge body provided with a boss in which to insert a spindle and a cam slidably supported in the hinge body for retracting the spindle. This makes it possible to not only easily bury the hinge body unit in the open frame, but also facilitates quick mounting and removal of the door in and from the open frame.

The hinge body unit can also be comprised of a hinge body buried and fixed at a position facing the hinge spindle unit of the open frame and a slide base disposed slidably against the hinge body and forming a spindle insertion hole so as to be fixed at any desired position on the hinge body. This makes it possible to easily adjust the position of the spindle insertion hole and mount the door accurately in the open frame.

DETAILED DESCRIPTION OF THE INVENTION

Embodiments of the hinge according to the present invention will be explained below based on the drawings.

FIG. 1(A) to FIG. 10 indicate a first embodiment of the hinge according to the present invention.

This hinge comprises a hinge spindle unit A, buried flush with the top and bottom lines on the fixed end of door D and disposed in a way to allow protrusion and retraction of a spindle 2, and a hinge body unit B, buried at a position facing the hinge spindle unit A in open frame K and supporting the door D to allow it to open and close with the protruding spindle 2 inserted in the hinge body unit B.

The hinge spindle unit A buried flush with the top and bottom lines on the fixed end of the door D is provided with a spindle case body 1 formed in a cylindrical shape, forming two ring grooves 1*d*, 1*e* on an outer circumferential face and having a hole 1*h* in which to insert the spindle 2, as shown in FIG. 2 and FIGS. 4(A)–(C). These two ring grooves 1*d*, 1*e* are formed at positions where a stopper 3 inserted from a shallow groove 1*c* to the hole 1*f* does not get away from the spindle case body 1 even if it swings back and forth like a seesaw.

A mounting flange 1*a* is integrally formed at an outer circumference on an opening end side of the spindle case body 1 and on the surface of the spindle case body 1 is formed, along the longitudinal direction of the spindle case body 1, a guide groove 1*b* regulating the sliding range of the spindle 2.

Moreover, along a lower position of the guide groove 1*b* is formed the shallow groove 1*c* and the hole 1*f* in which the stopper 3 is inserted, and in the connecting area between the inner bottom part of the shallow groove 1*c* and the hole 1*f* is formed a sloped face 1*g*.

Furthermore, at the outer circumference of the spindle case body 1, a fastening claw 1*s* is formed in proximity to the mounting flange 1*a*, so that the spindle case body 1 may be fixed so as not to turn when, buried in the hinge mounting hole H formed at the top and the bottom on the fixed end of the door D.

Figure 5:
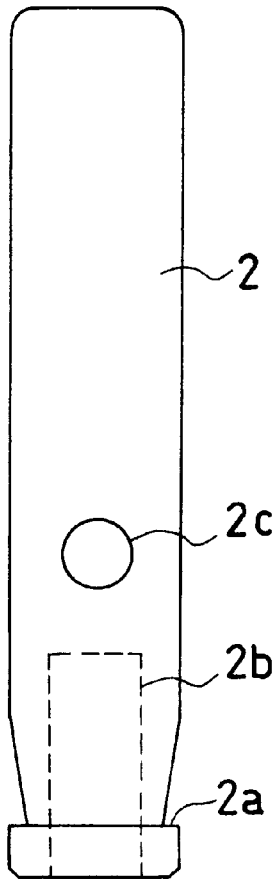
FIGS. 5(A) and (B) indicate a spindle, (A) being a front elevation, and (B) a bottom view.
Figure 5:
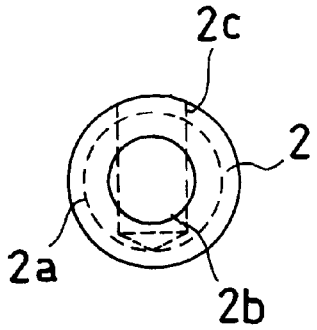
Figure 6:
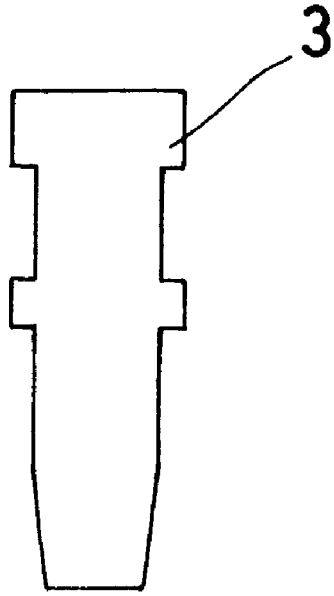
FIGS. 6(A) and (B) indicate a stopper, (A) being a front elevation, and (B) a bottom view.
Figure 6:
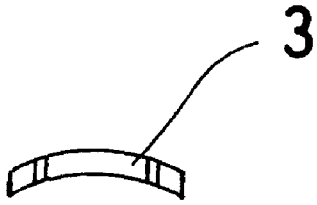
Figure 7:
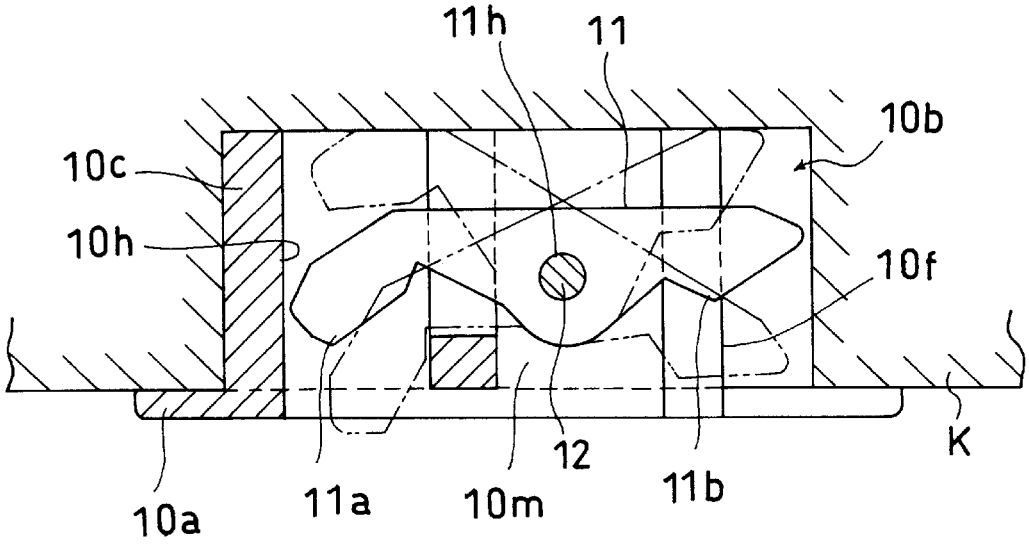
FIG. 7 is an explanatory drawing of actions of a cam in a hinge body unit.
Figure 8:
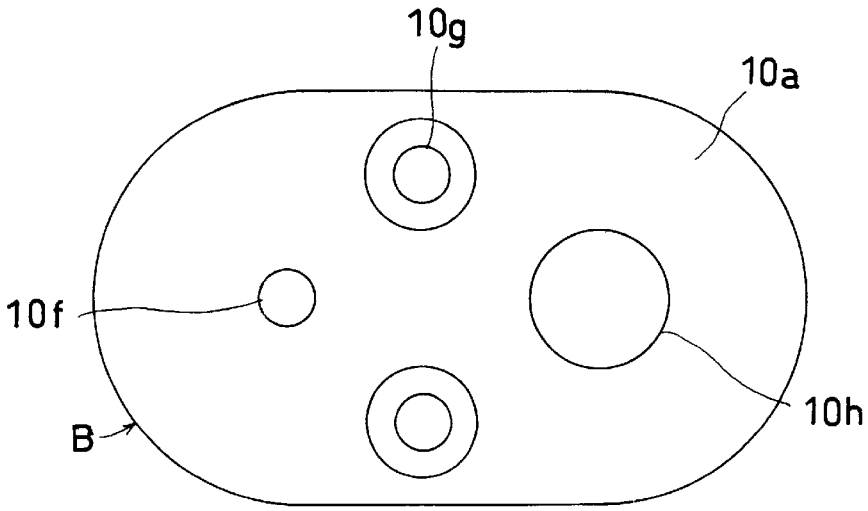
FIGS. 8(A)–(C) indicate a hinge body, (A) being a plan view, (B) a front elevation, and (C) a bottom view.
Figure 8:
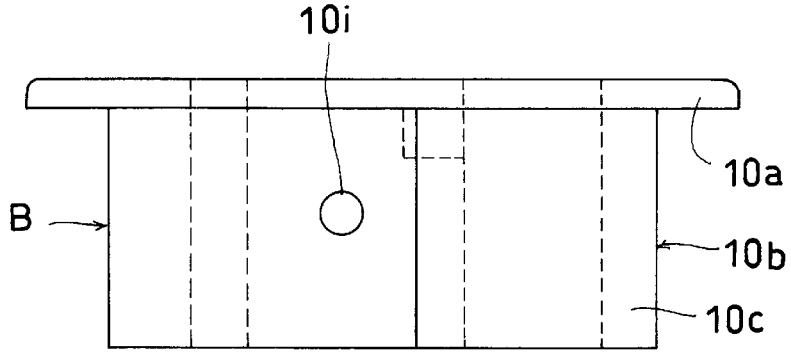
Figure 8:
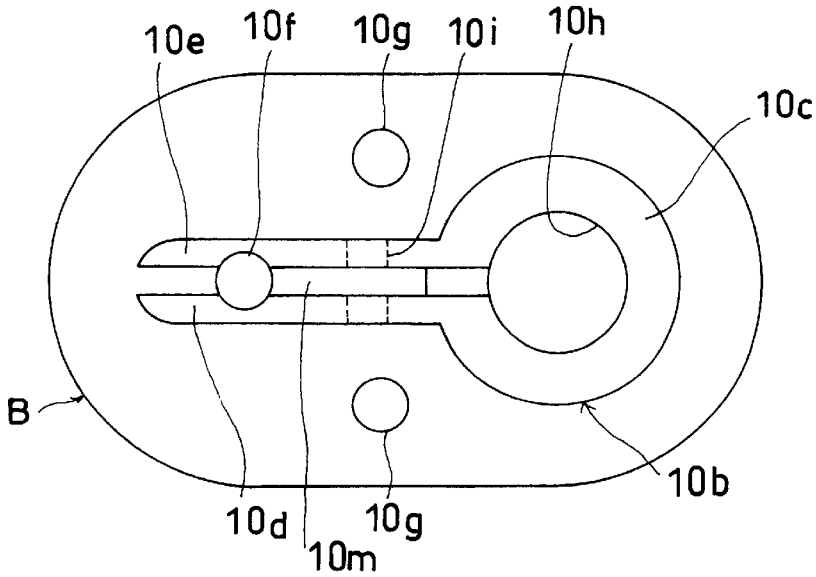

The spindle 2 to be inserted in the hole 1*h* in the spindle case body 1 has a length and a diameter sufficient for supporting the door D so that it can open and close, a fastening claw 2*a* formed at its bottom end with a stepped shape so that it may be fastened by (abutted against) the tip of the stopper 3, a spring insertion hole 2*b*, formed inside its bottom end and a guide insertion hole 2*c* formed on its outer circumferential face in a direction orthogonal to the shaft center of the spindle 2, as shown in FIG. 5.

This spindle 2 has an outside diameter to be inserted, without play and to allow it to protrude and retract, in the hole 1*h* in the spindle case body 1 with an allowable range of tolerance, and be formed such that the tip of the spindle 2 may be inserted, at the time of protrusion, in the hinge body unit B to support the door D to allow it to open and close. Still more, since the spindle 2 is urged by a spring 4 inserted in the inner bottom of the hole 1*h* in the spindle case body 1, a guide 5 will be inserted in the guide insertion hole 2*c* so that the spindle 2 will not get out of the spindle case body 1 due to this urging force.

This guide 5 will be inserted in the guide insertion hole 2*c* with a spring 6 so that a small-diameter portion 5*a* at the tip of the guide 5 may constantly protrude under the urging force of the spring 6, and the small-diameter portion 5*a* at the tip of this guide 5 will be inserted in the guide groove 1*b*, thereby prevent the guide 5 from getting out of the spindle 2 and prevent the spindle 2 from getting out of the spindle case body 1.

Yet more, the stopper 3 is provided on the spindle case body 1. The stopper 3 is formed from a thin metallic element so as to be slightly curved, so that the spindle 2 may have a concave face, as shown in FIG. 6(B). The stopper 3 is inserted from the shallow groove 1*c* to the hole 1*f* of the spindle case body 1, and is supported so as to act as a seesaw and slidably and in a slightly inclined position, as shown in FIG. 3(C), normally, by means of stopper rings 7, 8 made of spring steel which fit in the ring grooves 1*d*, 1*e* so that the stopper 3 may not get away from the spindle case body 1.

In this case, the swing angle of the stopper 3 is controlled by the slope face 1*g* formed at the inner bottom of the shallow hole 1*c* in the spindle case body 1. The swing angle of this stopper 3 and its positional relation in the spindle case body 1 are stipulated in such a way that the fastening claw 2*a* of the spindle 2 is fastened by (abutted against) the tip of the stopper 3, when the spindle 2 is completely retracted in the hole 1*h* in the spindle case body 1, as shown in FIG. 3(A).

Moreover, the outer face at fixed end of the stopper 3 is constructed in such a way that the stopper 3 swings to release the fastening (abutment) between the tip of the stopper 3 and the fastening claw 2*a*, as this outer face is pushed by an operating rod L inserted through an insertion hole Dh formed at the end face of the door D, as shown in FIG. 3(B).

On the other hand, the hinge body unit B buried at a position facing the hinge spindle unit A of the open frame K is provided with a hinge body 10 buried in the open frame K, and a cam 11 swingably supported by a shaft 12 in this hinge body 10, as shown in FIG. 2 and FIG. 7 to FIG. 9.

The hinge body 10 includes a mounting collar 10*a* fixed to the open frame K, and a barrel 10*b* integrally formed on a back face of the mounting collar 10*a*. The barrel is to be burred in the open frame K and is smaller in size than the mounting collar 10*a*.

This barrel 10*b* is formed, as shown in FIGS. 8(B), (C), with a boss 10*c* having a hole 10*h* in which to insert an end of the spindle 2, and cam supporting elements 10*d*, 10*e*, disposed on an outer circumferential face of this boss 10*c* so as to mutually face with a groove 10*m* formed in between and a shaft hole 10*i* formed in these cam supporting elements 10*d*, 10*e*. The width of the groove 10*m* is determined so that the cam 11 may swing on the shaft 12 inserted through the shaft hole 10*i*. Further, a cam push hole 10*f* is formed passing through the mounting collar 10*a* at the edge position of the groove 10*m*. This cam push hole 10*f* and the hole 10*h* in the boss 10*c* are formed so that their centers are positioned on the longitudinal shaft center of the groove 10*m*. In addition, set screw holes 10*g* are formed in the mounting collar 10*a*.

Figure 9:
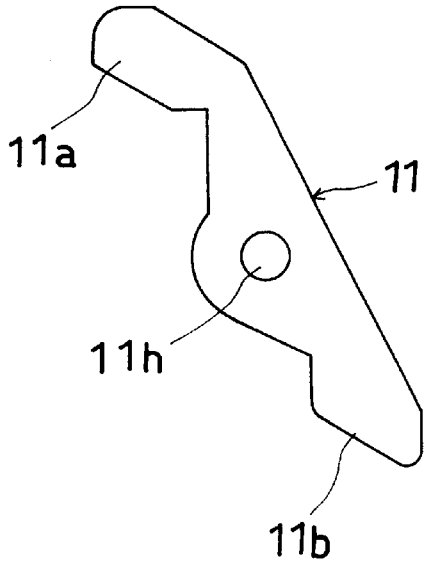
FIGS. 9(A) and (B) indicate the cam, (A) being a plan view, and (B) a side view.
Figure 9:
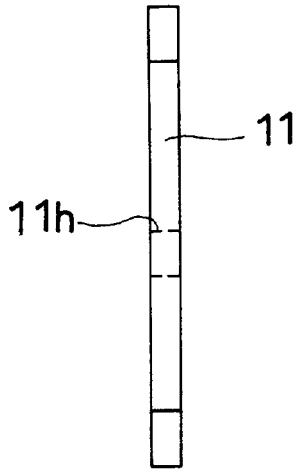

The cam 11 has a flat shape, as shown in FIG. 9, and is swingably supported on the hinge body 10 by the shaft 12 inserted through the shaft hole 11*h* formed at about the center, and has a spindle pushing element 11*a* at an end for pressing the head of the spindle 2 and a rod pushing element 11*b* at an outer end to be pressed by the operating rod L.

Next, the assembling method and actions of this hinge will be explained.

The stopper 3 is fixed at the outer circumference of the spindle case body 1, and the hinge spindle unit A, in which is inserted the spindle 2, through the spring 4 so as to be locked with the a guide 5, buried along a same line at the top and the bottom on the fixed end side of the door D respectively. In this case, by pushing the spindle 2 into the spindle case body 1 against the urging force of the spring 4, the fastening claw 2*a* of the spindle is fastened by (abutted against) the tip of the stopper 3, and the spindle 2 is kept retracted in the spindle case body 1. In addition, the hinge body unit B, on which is swingably disposed the cam 11, is buried in the open frame K, at a position where the spindle insertion hole 10*h* faces the spindle 2 of the hinge spindle unit A buried in the door D.

Next, the door D is mounted in the open frame K by installing the door D at a prescribed position of the open frame K, inserting the operating rod L in the rod insertion hole Dh formed at the end face of the door D, by adjusting the position of the spindle insertion hole 10*h* of the hinge body unit B to that of the spindle 2 of the hinge spindle unit A, and making the stopper 3 swing by pushing the outer side face on the fixed end of the stopper 3 with the tip of the operating rod L to release the fastening with the fastening claw 2*a* of the spindle 2. This makes it possible for the spindle 2 to protrude from the spindle case body 1 with the urging (baising) force of the spring 4. Since the small-diameter shaft portion 5*a* of the guide 5 in the spindle 2 is inserted in the guide groove 1*b*, the spindle 2 stops and is prevented from being completely removed when this small-diameter shaft portion 5*a* of the guide 5 contacts the end position of the guide groove 1*b*. Further, the head of the spindle 2 protruding from the spindle case body 1 is inserted in the spindle insertion hole 10*h* on the hinge body unit B side. In this way, by making the spindles 2, 2 of the respective spindle units A provided at the top and bottom of the door D protrude, it becomes possible to mount the door D in the open frame K to allow it to open and close on the spindles 2, 2.

Figure 1:
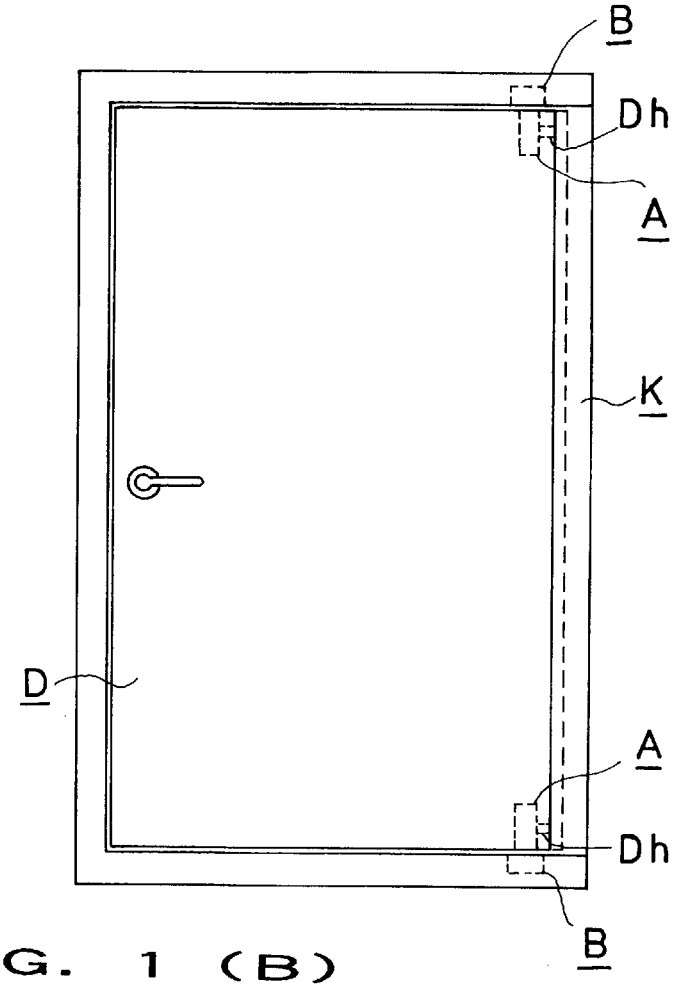
FIGS. 1(A) and 1(B) are explanatory drawings showing a door and an open frame to which is applied a hinge according to the present invention, (A) being a front elevation, and (B) a transverse sectional plan view.
Figure 1:
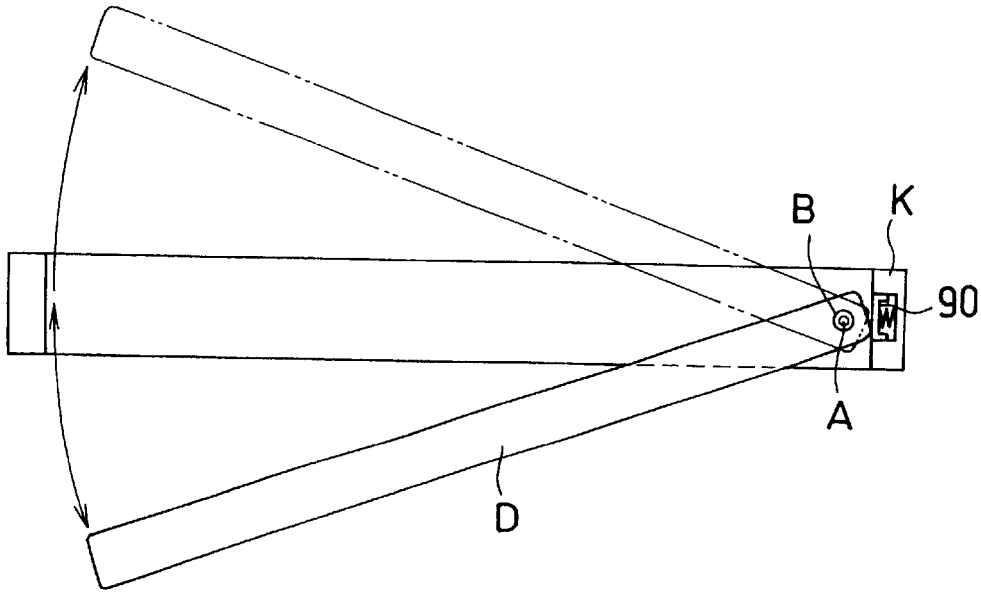
Figure 2:
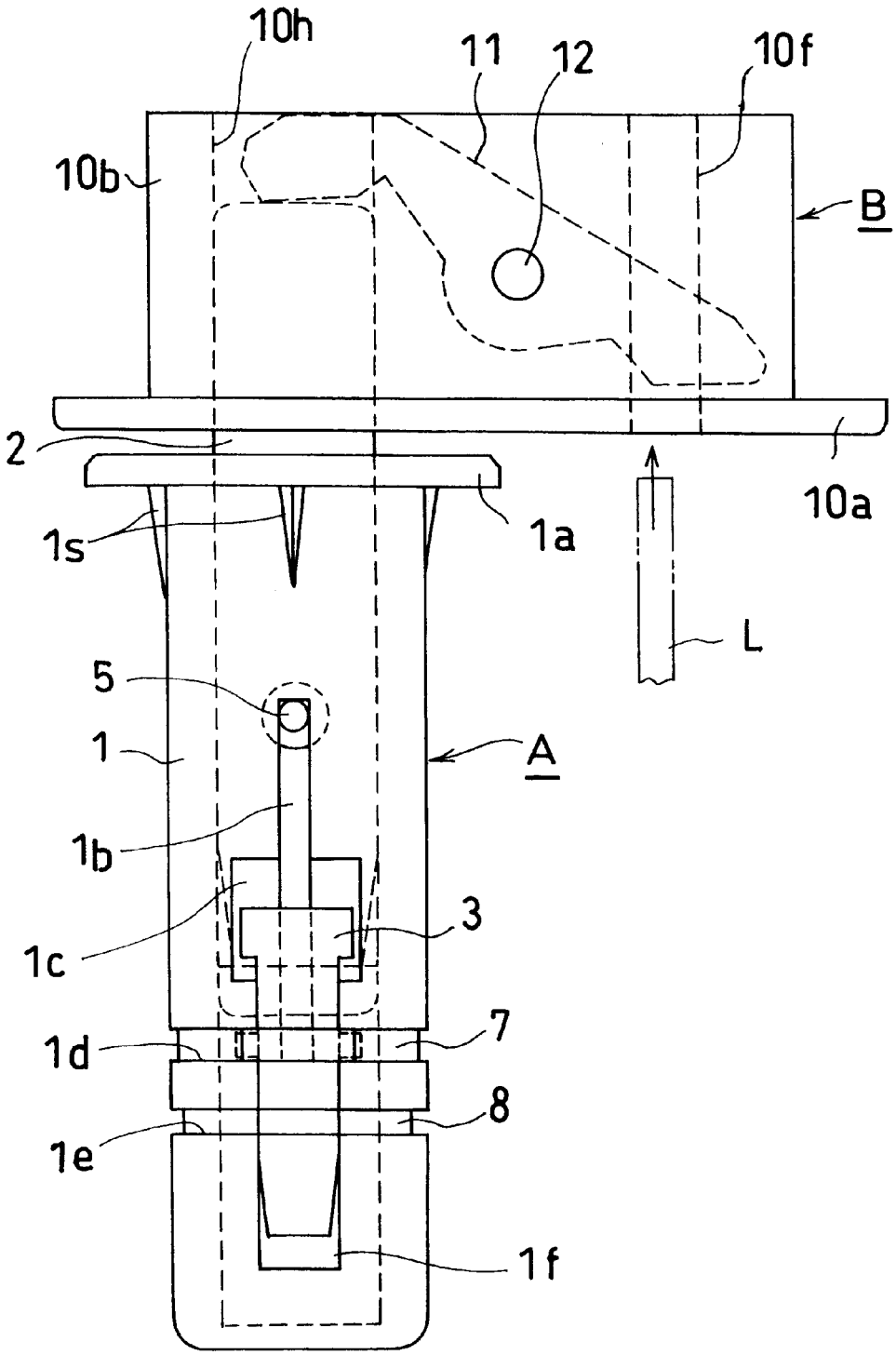
FIG. 2 is a front elevation showing a first embodiment of the hinge according to the present invention.
Figure 3:
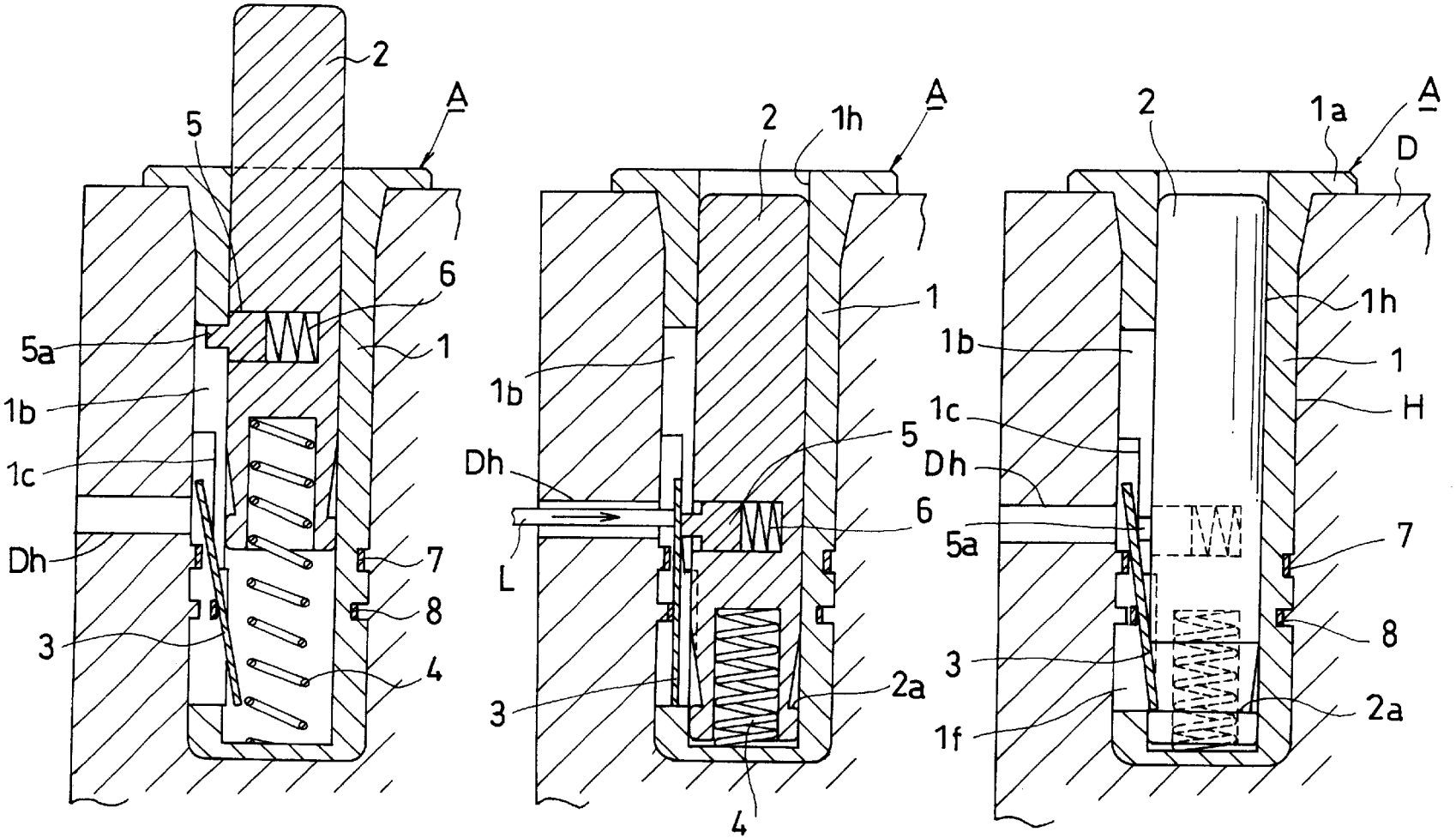
FIGS. 3(A)–(C) are explanatory drawings of operations of the above.
Figure 4:
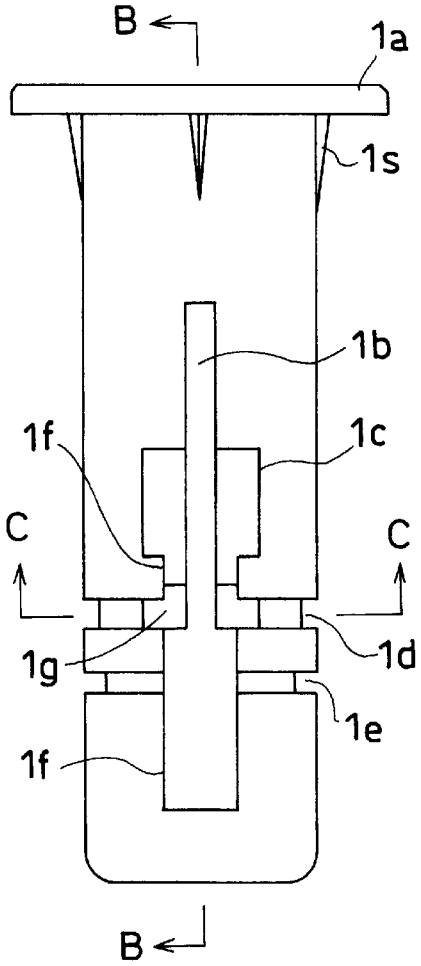
FIGS. 4(A)–(C) indicate a spindle case body, (A) being a front elevation, (B) a sectional view taken at line B—B, and (C) a sectional view taken at line C—C.
Figure 4:
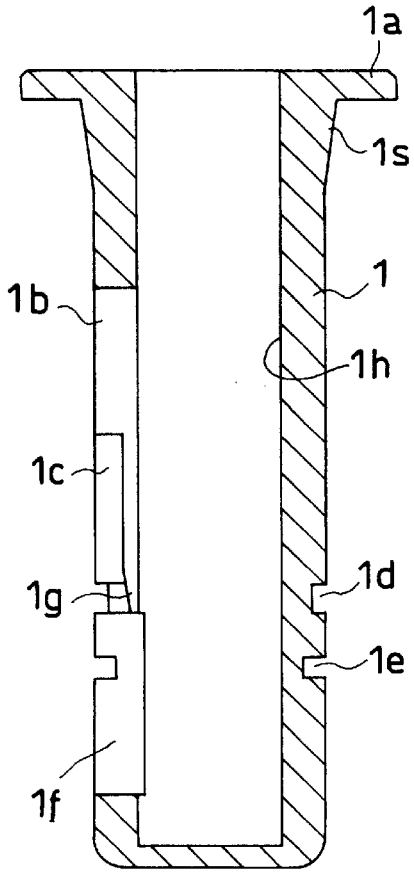
Figure 4:
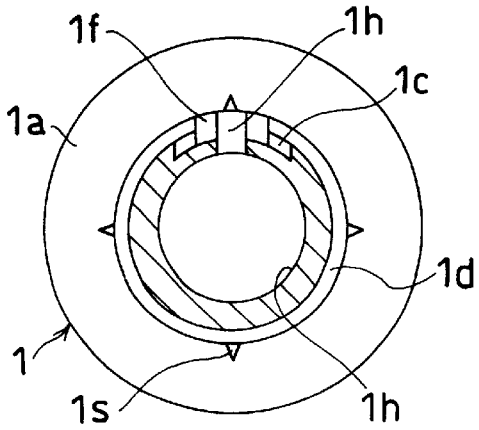

At this time, if the head of the spindle 2 is inserted in the spindle insertion hole 10*h*, with a protrusion of the spindle 2 of approximately 10 mm to 30 mm, for example, the spindle pushing element 11*a* of the cam 11 positioned on the spindle insertion hole 10*h* is pushed up by the head of the spindle 2, as shown in FIG. 2. As a result, the cam 11 swings around the shaft 12, and the rod pushing element 11*b* on the opposite side of the cam is held in the pushed down state.

On the other hand, to remove the door D from the open frame K, expose the cam pushing hole 10*f* of the hinge body unit B buried in the open frame K by keeping the door D open, insert the operating rod L in this cam pushing hole 10*f*, and push the rod pushing element 11*b* of the cam 11 to make the rod pushing element 11*b* of the cam 11 go up. As a result, the cam 11 swings around the shaft 12, and the head of the spindle 2 is pushed down, through the spindle pushing element 11*a* on the opposite side.

In this way, as the spindle 2 is pushed into the spindle case body 1 against the urging force of the spring 4, the fastening claw 2*a* is fastened by (abutted against) the tip of the stopper 3, and the spindle 2 is kept retracted in the spindle case body 1. As a result, the spindle 2 is held in the spindle case body 1 in the retracted state, and unfastened from the hinge body unit B buried in the open frame K. By performing this operation for both of the hinge spindle units A, A buried at the top and the bottom on the fixed end side of the door D, it becomes possible to remove the door D from the open frame K.

In the above case, the operating sequence of the hinge spindle units A, A buried at the top and the bottom on the fixed end side of the door D is not particularly restricted, and can be made from either the top or the bottom side.

Figure 10:
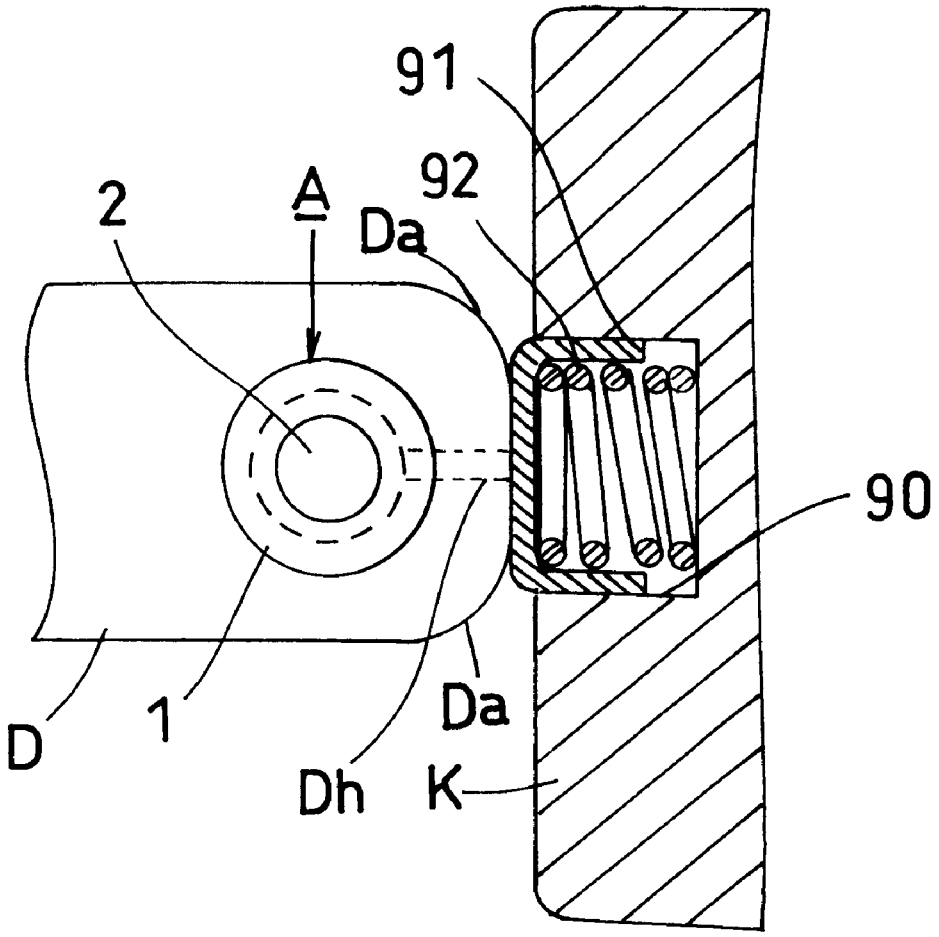
FIG. 10 is a sectional view showing the door and the open frame.

By the way, in the case where the door D is mounted to open and close on the spindles 2, 2, it is necessary to form the surface on the fixed end side of the door D with a sloped shape and form a prescribed gap between the surface on the fixed end side of the door D and the open frame K, to ensure smooth opening and closing of the door D. To meet these requirements, it is possible to perform chamfering Da on the surface on the fixed end side of the door D and adopt a construction of disposing a door pad 91 so as to protrude and retract under the urging force of a spring 92 in a concave part 90 formed in the open frame K, as shown in FIG. 10, to thereby avoid producing a gap between the surface on the fixed end side of the door D and the open frame K.

Figure 11:
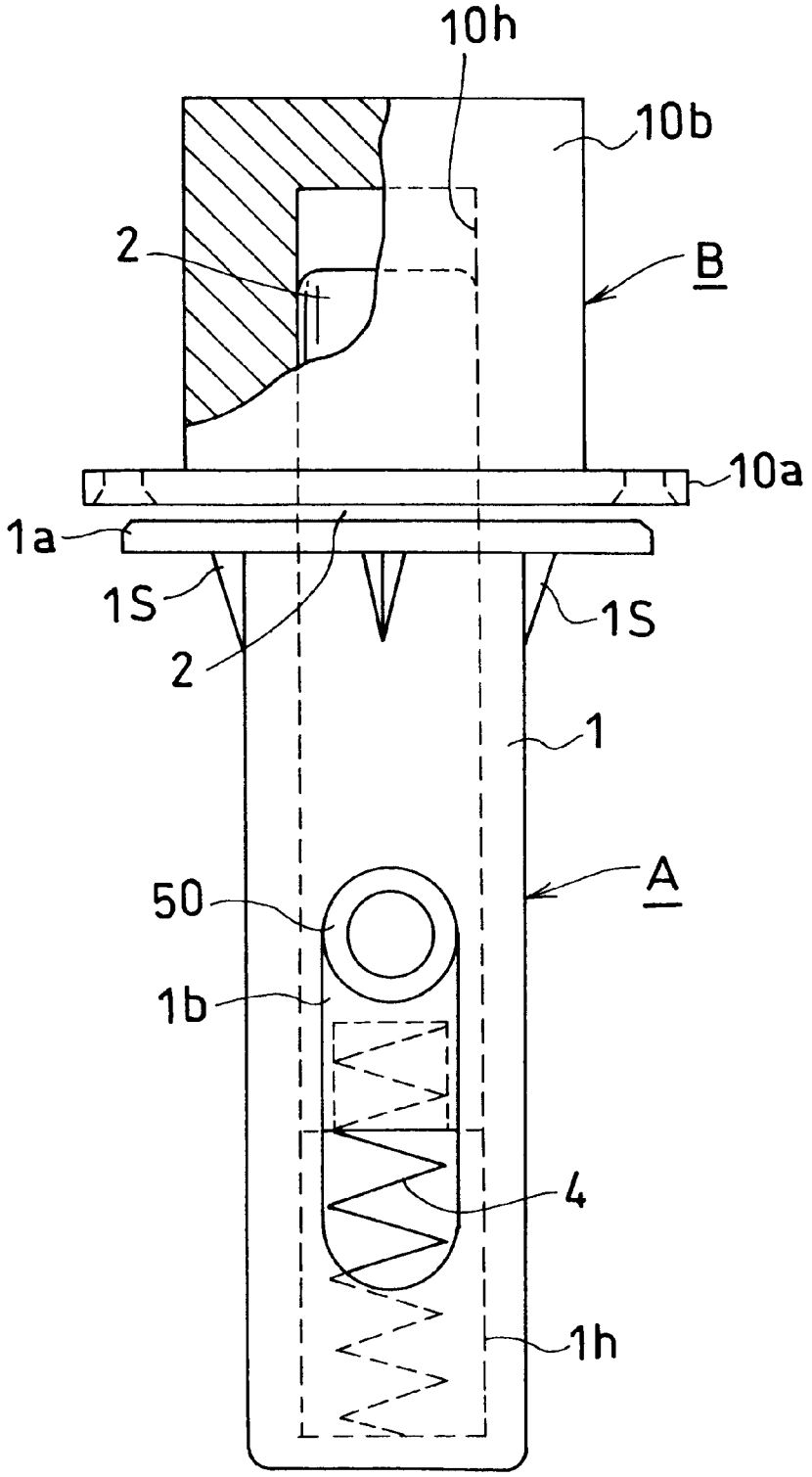
FIG. 11 is a front elevation showing a second embodiment of the hinge according to the present invention.
Figure 12:
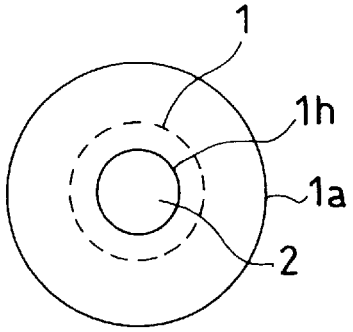
FIGS. 12(A)–(D) indicate the hinge spindle unit, (A) being a sectional view, (B) a front elevation, (C) a plan view, and (D) a bottom view.
Figure 12:
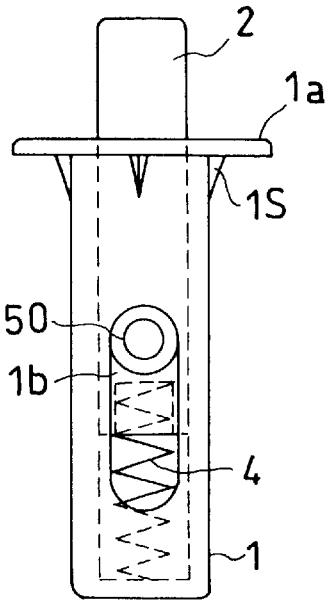
Figure 12:
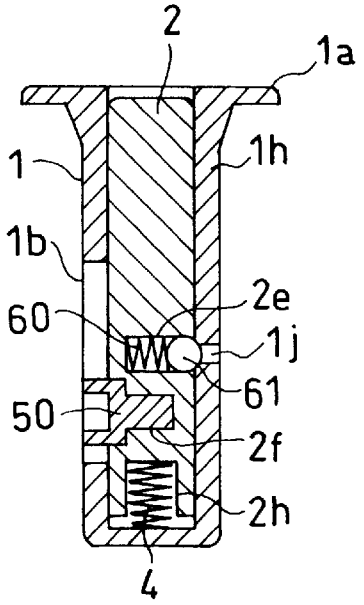
Figure 12:
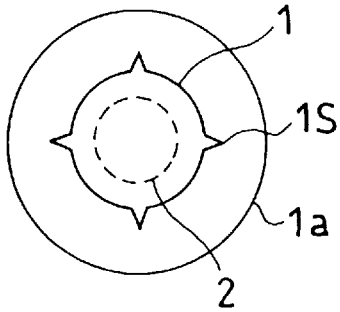

FIG. 11 and FIG. 12 indicate the second embodiment of the hinge according to the present invention. This hinge is constructed, as is the hinge of the first embodiment, with the hinge spindle unit A, buried flush with the top and bottom lines on the fixed end side of the door D and disposed so as to allow protrusion and retraction of the spindle 2, and the hinge body unit B, buried at a position facing the hinge spindle unit A of the open frame K and supporting the door D to allow it to open and close when the protruding spindle 2 is inserted in the hinge body unit B.

In this embodiment, the hinge spindle unit A buried flush with the top and bottom lines on the fixed end of the door D is provided with a spindle case body 1, formed in a cylindrical shape having a hole 1*h* in which to insert the spindle 2, and a spindle 2. At the outer circumference on the opening end side of the spindle case body 1 is integrally formed a mounting flange 1*a*, and on the surface of the spindle case body 1 is formed, along the longitudinal direction of the spindle case body 1, a guide groove 1*b* in which to insert an opening element 50 for regulating the sliding range, i.e., range of protrusion and retraction of the spindle 2. Moreover, at the outer circumference of the spindle case body 1 is formed a fastening claw 1*s* in proximity to the mounting flange 1*a*, so that the spindle case body 1 may be fixed so as not to turn when buried in the hinge mounting hole H formed at the top and the bottom on the fixed end of the door D.

The spindle 2 has a length and a diameter sufficient for supporting the door D to allow it to open and close, a spring insertion hole 2*h* formed inside its bottom end, a stopper ball insertion hole 2*e*, formed on its outer circumferential face, and an operating element insertion hole 2*f* in a direction orthogonal to the shaft center of the spindle 2.

This spindle 2 has an outside diameter to be inserted, without play and so as to protrude and retract, in the hole 1*h* in the spindle case body 1 within an allowable range of tolerance, and is formed such that the tip of the spindle 2 may be inserted, at the time of protrusion, in the hinge body unit B to support the door D to allow it to open and close. Furthermore, since the spindle 2 is urged by a spring 4 inserted in the inner bottom of the hole 1*h* in the spindle case body 1 and the spring insertion hole 2*h*, the operating element 50 is inserted in the guide insertion hole 2*c* provided as a projection from the spindle 2 so that the spindle 2 may not get out of the spindle case body 1 due to of this urging force. This operating element 50 has a small diameter at a fixed end to be inserted by either forced fitting or screw fastening in the operating element insertion hole 2*f* of the spindle 2, and a large diameter with a hole in which to insert the tip of the operating rod, the large-diameter portion being inserted in the guide groove 1*b*, to thereby prevent the spindle 2 from coming out of the spindle case body 1 with the operating element 50.

In the stopper ball insertion hole 2*e* of the spindle 2 is inserted a stopper ball 61 so as to be urged by a spring 60 in a direction pushing the stopper ball 61 out through the stopper ball insertion hole 2*e*. The spindle case body 1 has a stopper hole 1*j* formed therein, as shown in FIG. 12(A), so that the spindle 2 may be held in a retracted state with a fitting of the stopper ball 61, when the spindle 2 is retracted in the spindle case body 1. Further, to make the spindle 2 protrude from the retracted state, held in the spindle case body 1, and be inserted into the hinge body B, the operating element 50 will be operated with the operating rod in a way to draw out the spindle 2 and release the fitting of the stopper ball 61 in the stopper hole 1*j*. This makes it possible for the tip of the spindle 2 to protrude from inside the spindle case body 1 with an action of the spring 4, as shown in FIG. 12(B).

On the other hand, the hinge body B side, buried at a position facing the hinge spindle unit A of the open frame K, is provided with a hinge body 10 to be buried in the open frame K, as shown in FIG. 11. The hinge body 10 includes a mounting collar 10*a* to be fixed to the open frame K, and a barrel portion 10*b* integrally formed on a back face of the mounting collar 10*a*. The barrel portion 10*b* has a hole 10*h* in which to insert the spindle 2, is to be buried in the open frame K, and is smaller size than the mounting collar 10*a*. The spindle insertion hole 10*h* is formed, either with a closed end or a way to pass through the barrel portion 10*b*.

Next, the assembling method and actions of this hinge will be explained.

The spring 60 and the stopper ball 61 are inserted in the stopper ball insertion hole 2*e* of the spindle 2. The spindle 2 is inserted in the hole 1*h* of the spindle case body 1 in which the spring 4 has been inserted. The fix the hinge spindle unit A having the operating element 50 projecting in the guide groove 1*b* is buried and fixed flush with the top and bottom lines on the fixed end side of the door D respectively. In this case, by operating the operating element 50 and pushing the spindle 2 into the spindle case body 1 against the urging force of the spring 4, the stopper ball 61 fits into the stopper hole 1*j*, and the spindle 2 is kept retracted in the spindle case body 1.

In addition, the hinge body unit B, on which is swingably disposed the cam 11, is buried in the open frame K, at a position where the spindle insertion hole 10*h* faces the spindle 2 of the hinge spindle unit A buried in the door D.

Next, to mount the door D in the open frame K, the door D is installed at a prescribed position of the open frame K, the position of the spindle insertion hole 10*h* in the hinge body unit B is adjusted to line up with the spindle 2 of the hinge spindle unit A, and, by operating the operating element 50 with the operating rod from the guide groove 1*b* formed on the end face of the door D, the stopper ball 61 is disengaged from the stopper hole 1*j*, drawing out the spindle 2. As a result, the spindle 2 protrudes from the spindle case body 1 under the urging force of the spring 4. Since the operating element 50 disposed on the spindle 2 is inserted in the guide groove 1*b*, the spindle 2 stops and is prevented from being completely removed when this operating element 50 contacts the end position of the guide groove 1*b*. Further, the head of the spindle 2 protruding from the spindle case body 1 is inserted in the spindle insertion hole 10*h* on the hinge body unit B side. In this way, by making the spindles 2, 2 of the respective spindle units A provided at the top and the bottom of the door D protrude, it becomes possible to mount the door D in the open frame K to allow it to open and close on the spindles 2, 2.

On the other hand, to remove the door D from the open frame K, the guide groove 1*b* formed at the end face of the door D is exposed by keeping the door D open. The operating rod L is inserted in this slit-shaped guide groove 1*b*, and the operating element 50 is operated with the operating rod and the spindle 2 is pushed into the spindle case body 1 against the urging force of the spring 4 to fit the stopper ball 61 into the stopper hole 1*j*, and keep the spindle 2 in the state retracted in the spindle case body 1.

As a result, the spindle 2 is held in the spindle case body 1 in the retracted state, and unfastened from the hinge body unit B buried in the open frame K. By performing this operation for both of the hinge spindle units A, A buried at the top and the bottom on the fixed end side of the door D, it becomes possible to remove the door D from the open frame K.

In the above case, the operating sequence of the hinge spindle units A, A buried at the top and the bottom on the fixed end side of the door D is not particularly restricted, and can be made from either the top or bottom side.

The other construction and actions of this embodiment are the same as those of the hinge of the first embodiment.

Figure 13:
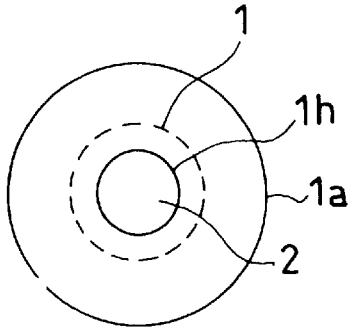
FIGS. 13(A)–(D) indicate a first modified example of the hinge spindle unit of the second embodiment of the present invention, (A) being a sectional view, (B) a front elevation, (C) a plan view, and (D) a bottom view.
Figure 13:
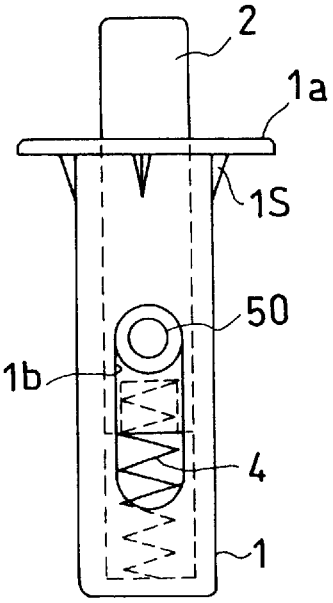
Figure 13:
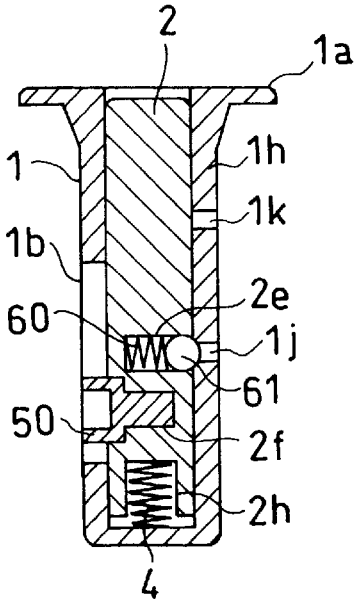
Figure 13:
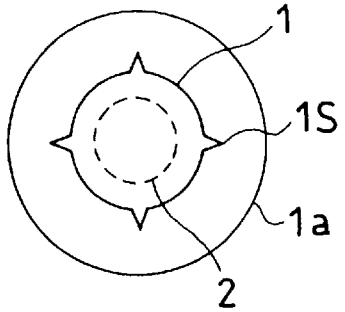

By the way, in the hinge of the second embodiment, a stopper hole 1*k* may be formed, as a first modified example of the hinge spindle unit in the second embodiment of the present invention indicated in FIG. 13, such that the spindle 2 may be held in a protruded state with a fitting of the stopper ball 61, when the tip of the spindle 2 protrudes from inside the spindle case body 1, so that the tip of the spindle 2 may be held securely in the state protruding from inside the spindle case body 1.

Figure 14:
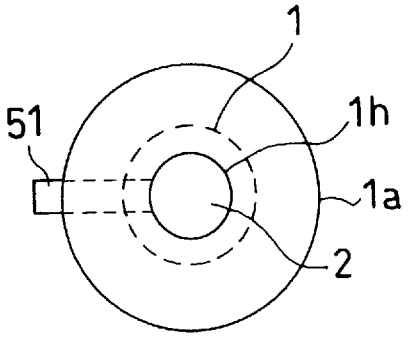
FIGS. 14(A)–(D) indicate a second modified example of the hinge spindle unit of the second embodiment of the present invention, (A) being a sectional view, (B) a front elevation, (C) a plan view, and (D) a bottom view.
Figure 14:
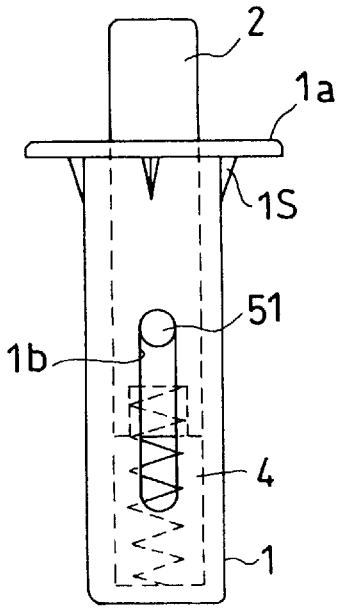
Figure 14:
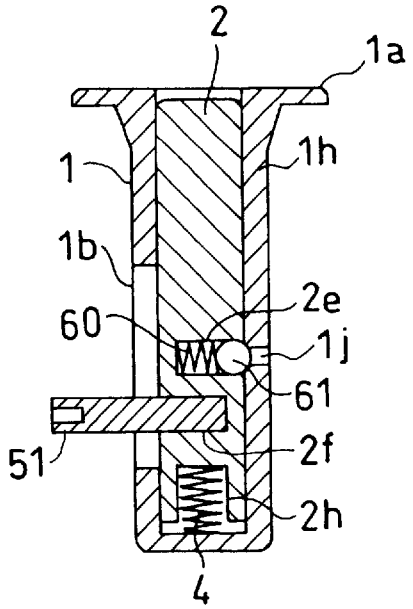
Figure 14:
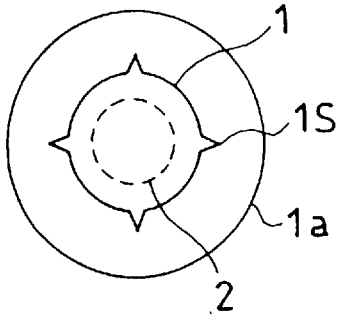
Figure 15:
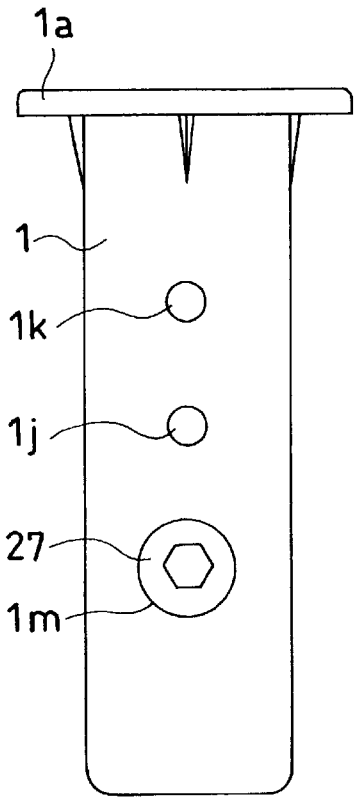
FIGS. 15(A)–(C) indicate a third modified example of the hinge spindle unit in the second embodiment of the present invention, (A) being a sectional view, (B) a front elevation, and (C) a bottom view.
Figure 15:
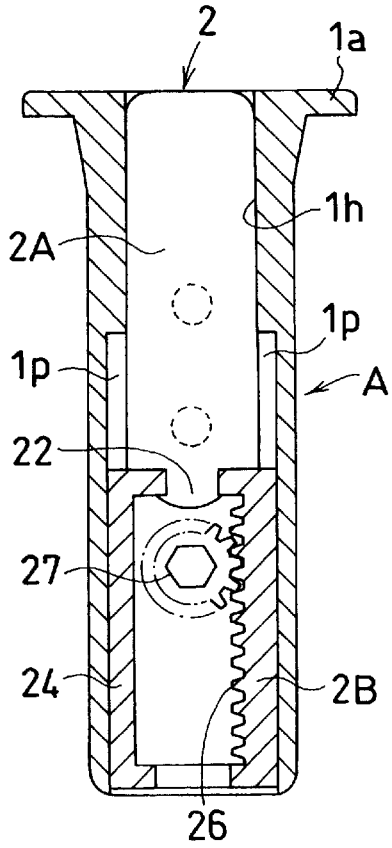
Figure 15:
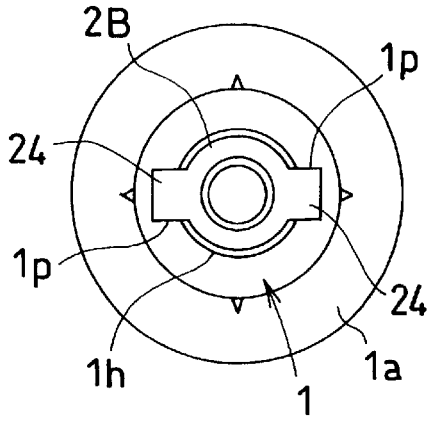
Figure 16:
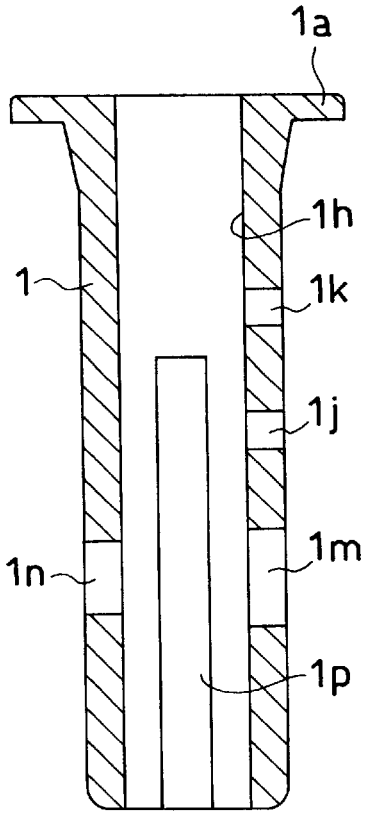
FIGS. 16(A)–(C) indicate the spindle case body, (A) being a front elevation, (B) a sectional view, and (C) a bottom view.
Figure 16:
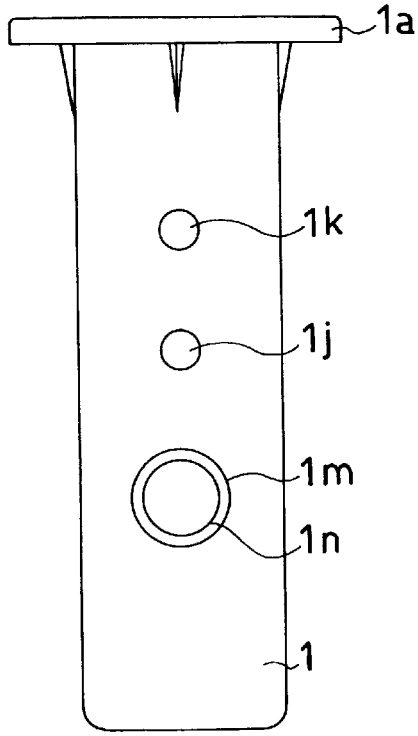
Figure 16:
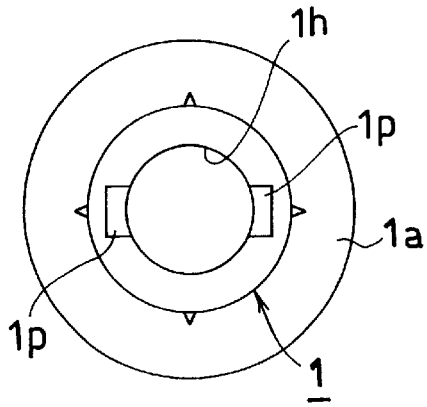

Moreover, the operating element of the spindle 2 may be formed so as to be directly operated, by inserting the operating element 51 formed in the shape of a pin in the operating element insertion hole 2*f* of the spindle 2 and making the tip of the operating element 51 protrude from the spindle case body 1, as a second modified example of the hinge spindle unit in the second embodiment of the present invention indicated in FIG. 14.

The other construction and actions of those modified examples are the same as those of the hinge of the second embodiment.

FIG. 15(A) to FIG. 19 indicate a third modified example of the hinge spindle unit in the second embodiment of the present invention.

This hinge is constructed, in the same way as the hinge of first embodiment and second embodiment, with a hinge spindle unit A, buried flush with the top and bottom lines on the fixed end side of the door D and disposed in a way to allow protrusion and retraction of the spindle 2, and a hinge body unit B, buried at a position facing the hinge spindle unit A of the open frame K and supporting the door D to allow it to open and close as the protruding spindle 2 is inserted in the hinge body unit B. In this case, the hinge spindle unit A buried flush with the top and bottom lines on the fixed end of the door D is provided with a spindle case body 1, formed in a cylindrical shape having a hole 1*h* in which to insert the spindle 2 in inserted inside, and the spindle 2. On the spindle case body 1 is disposed a pinion 27, and a rack gear 26 engaged with this pinion 27 is formed on the spindle 2 and disposed so that the spindle 2 may protrude from and be retracted into the spindle case body 1 with a turn of the pinion 27. To be more concrete, the spindle case body 1 has, as shown in FIGS. 15(A)–(C) and FIGS. 16(A)–(C), a hole 1*h* formed therein in which to insert the spindle 2 and a mounting flange 1*a* on an outer circumference of the opening.

Figure 17:
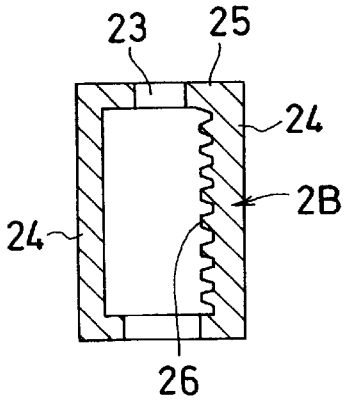
FIGS. 17(A)–(D) indicate the spindle, (A) being a front elevation of a spindle body element, (B) a bottom view, (C) a sectional view of a rack gear element, and (D) a bottom view.
Figure 17:
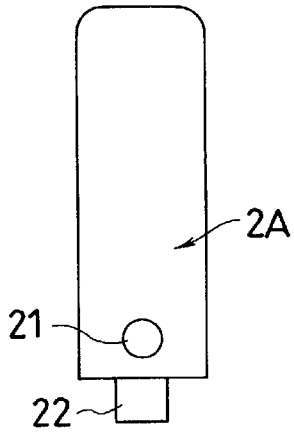
Figure 17:
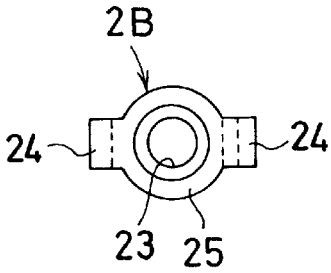
Figure 17:
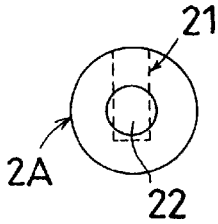

A rack gear insertion groove 1*p* is formed along the longitudinal direction on an inner circumferential surface of the hole 1*h* in which to insert the spindle 2, and holes 1*j*, 1*k* in which to insert a stopper ball 61 to be described later will be formed at two points along the longitudinal direction of the spindle case body 1, while gear insertion holes 1*m*, in with different diameters will further be formed so as to pass in a transversal direction through the circumferential wall of the spindle case body 1, at a position close to the hole The length and width of this rack gear insertion groove 1*p* are determined so that the spindle 2 slides only in the longitudinal direction of the spindle case body 1 without turning. The spindle 2 will be composed of a bar-shaped spindle body element 2A and a rack gear element 2B forming a rack gear 26, as shown in FIG. 17, and its overall length will be set to be completely retracted in the spindle case body 1.

In the spindle body element 2A will be formed a stopper ball insertion hole 21, and in this stopper ball insertion hole 21 will be inserted a stopper ball 61 so as to be urged in the direction of pushing out from the stopper ball insertion hole 21 by means of a spring 60. In this case, the stopper ball insertion hole 21 will be formed in the direction agreeing with the holes 1*j*, 1*k* in the spindle case body 1. It will be so arranged that the spindle 2 may be stably held selectively in either a retracted or protruded state, as the stopper ball 61 fits in the holes 1*j*, 1*k* formed in the spindle case body 1. Moreover, at the bottom of the spindle body element 2A is provided a fastening element 22 of small diameter in projection, and this fastening element 22 will be inserted in a hole 23 formed in the rack gear element 2B and caulked at the tip, to integrate the spindle body element 2A and the rack gear element 2B.

The rack gear element 2B has its side faces in longitudinal direction formed in side elements 24, 24 having a width suitable for insertion in the rack gear insertion groove 1*p*, and has formed, in an end element for connecting the side elements 24, 24, the hole 23 for inserting the fastening element 22 provided in projection on the spindle body element 2A. In addition, on the inside of one side element 24 will be formed the rack gear 26, and the tip of the fastening element 22 inserted in the hole 23 will be caulked to integrate the rack gear 26 with the spindle body element 2A. In this case, the orientation of the spindle body element 2A and the rack gear element 2B will be adjusted so that the rack gear 26 may mutually bite with the pinion 27 inserted in the spindle case body 1.

Figure 18:
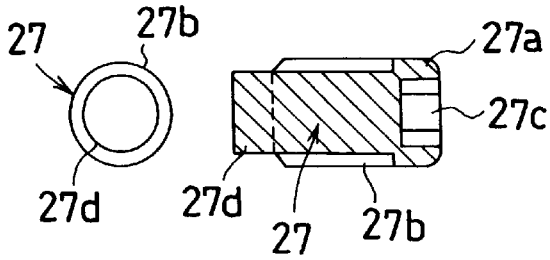
FIGS. 18(A) and (B) indicate a pinion, (A) being a side view, and (B) a sectional view.

The pinion 27 will have a length about equal to the outside diameter of the spindle case body 1, and will be formed with an outside diameter to be supported in a hole 1*m* of large diameter formed in the spindle case body 1 at the fixed end 27*a* and with an outside diameter to be supported in a hole 1*n* of small diameter formed in the spindle case body 1 at the tip 27*d*, and a gear 27*b* will be serrated on the outer circumferential face at an intermediate area, as shown in FIG. 18. Furthermore, on the end face of the fixed end 27*a* of the pinion 27 will be formed an operating hole 27*c* for turning the pinion 27 by means of a tool (not illustrated) such as hexagon wrench, etc. to be inserted from outside the door D.

Figure 19:
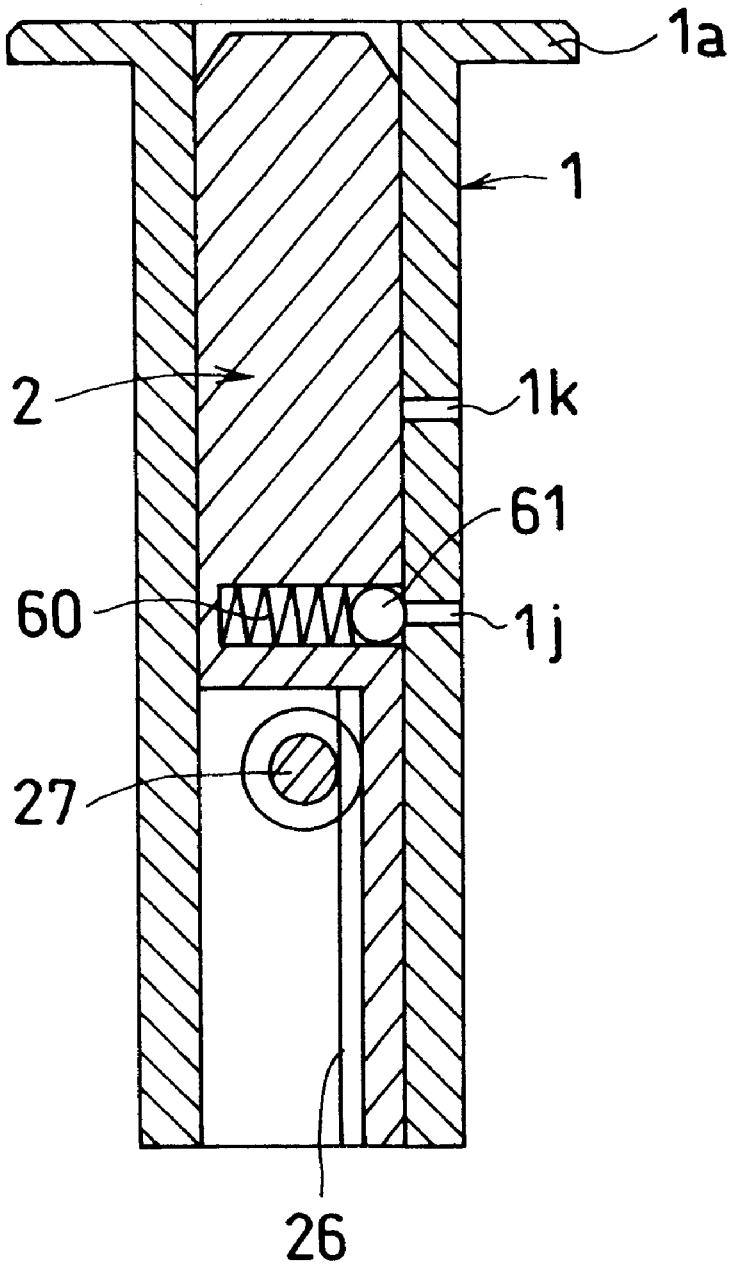
FIG. 19 is a sectional view showing the entire part of the third modified example.

Although, in this embodiment, the spindle 2 is composed of a spindle body element 2A and a rack gear element 2B, the spindle 2 may also be composed of a single member, as in a modified example given in FIG. 19. In this case, a space for inserting the pinion 27 will be formed at a lower part of the spindle 2, and a part of the side area of the spindle 2 will be notched, and on this notched face will be serrated the rack gear 26.

Figure 20:
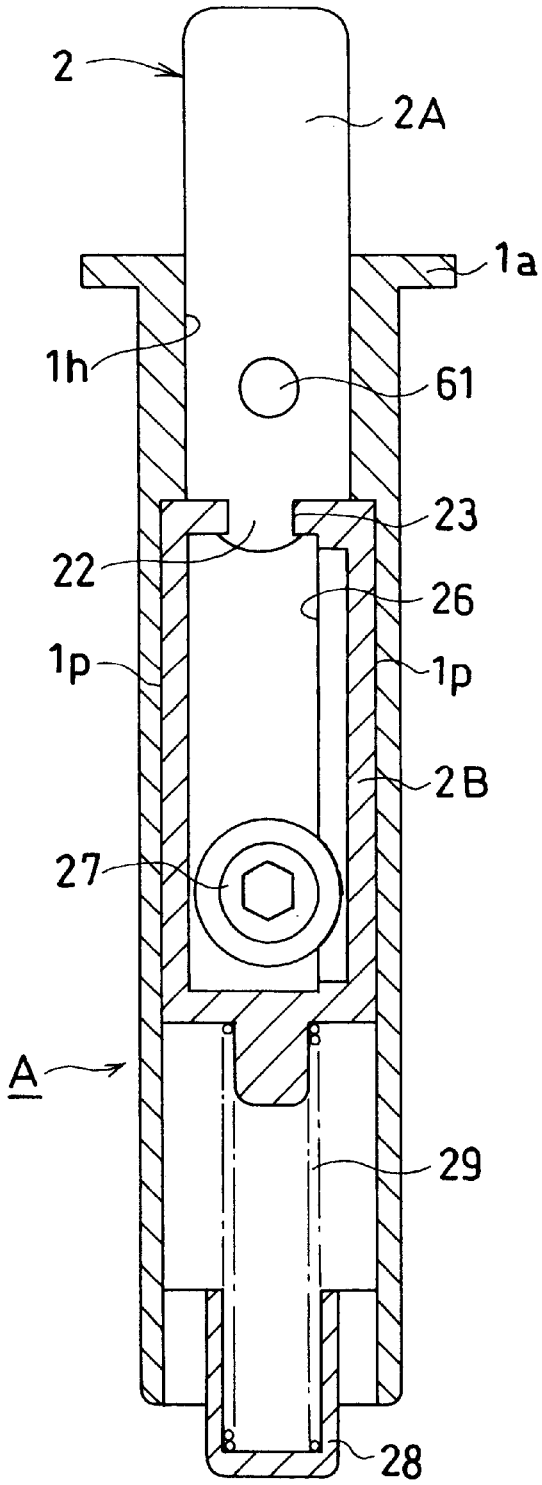
FIG. 20 indicates a fourth modified example of the hinge spindle unit.

FIG. 20 indicates a fourth modified example of the hinge spindle unit in the second embodiment of the present invention.

The hinge spindle unit in this fourth modified example of the second embodiment basically has the same form as that of the third modified example, but is different from the latter in that, while the protruding and retracting actions of the spindle 2 are performed by making the rack gear element 2B move up and down with a rotation of a pinion in the third modified example, the protruding action of the spindle 2 is made with the urging force of a spring 29 and the retracting action is performed by means of a pinion 27 and a rack gear element 2B in this fourth modified example. Further, in this fourth modified example, the hinge spindle unit is composed of a spindle case body 1 formed in the shape of a cylinder having a mounting flange 1*a* on an outer circumference of the opening, and a spindle 2 to be inserted in the spindle case body 1 as so to protrude and retract, and is constructed so as to push and support the bottom end of the spindle 2 by means of a spring 29 supported by a spring fastening device 28 fastened to the spindle case body 1.

The spindle 2 integrates a bar-shaped spindle body element 2A and a rack gear element 2B having a rack gear 26 serrated on the inside by caulking a fastening element 22, in the same way as in the third modified example, and a pinion 27 rotatably supported in the spindle case body 1 passes through the rack gear element 2B and meshes with the rack gear 26. In addition, it is so arranged that, when the rack gear 26 is turned by means of a tool such as hexagon wrench, etc. inserted in the hexagon hole of this rack gear 26, the spindle body element 2A is retracted into the spindle case body 1 against the spring pressure through the rack gear element 2B fit to the rack gear 26.

This spindle 2 is designed to move along the rack gear insertion hole 1*p* serrated on the inner face of the spindle case body 1, and constantly protrude from the spindle case body 1 with the elastic force of a spring 29 supporting the bottom part. In order, to maintain the spindle 2 in the retracted state in the spindle case body 1, as shown in FIG. 15(A), a ball 61 is inserted under spring pressure in the spindle body element 2A in the same way as shown in FIG. 19, so that the ball 61 will fit the stopper hole 1*j* formed in the spindle case body 1 at the spindle retracting position.

The other basic construction and actions of this embodiment and its modified examples are the same as those of the hinge of the second embodiment, except for the difference in the mechanism for protruding and retracting the spindle 2.

Figure 21:
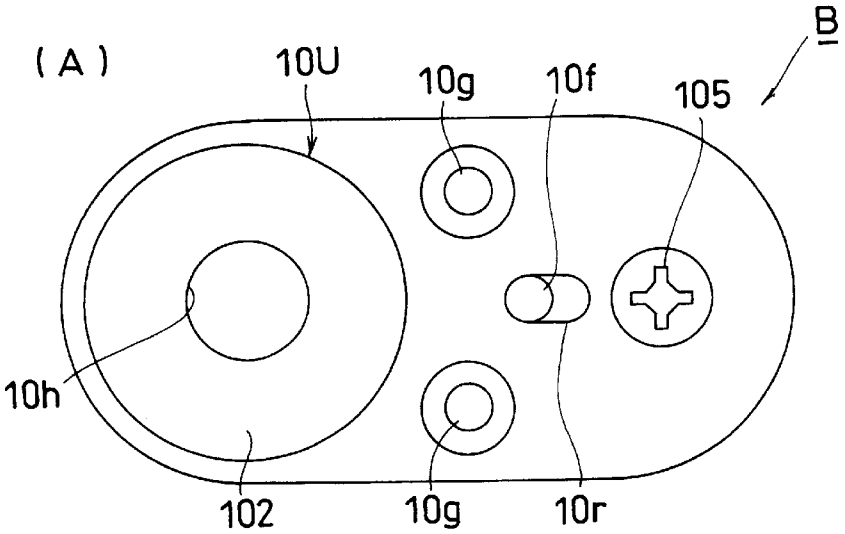
FIGS. 21(A)–(C) indicate a first modified example of the hinge body unit of the second embodiment of the present invention, (A) being a plan view, (B) a front elevation, and (C) a sectional view.
Figure 21:
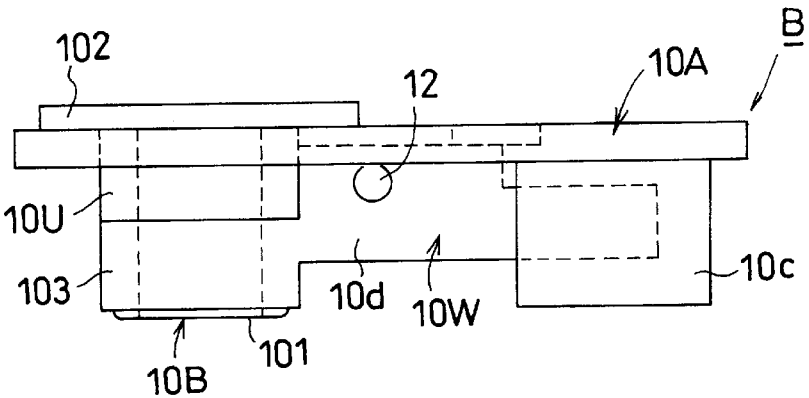
Figure 21:
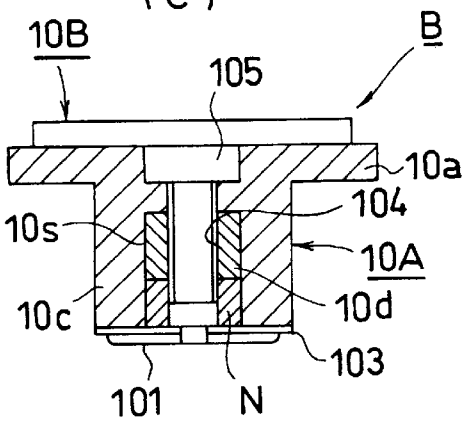
Figure 22:
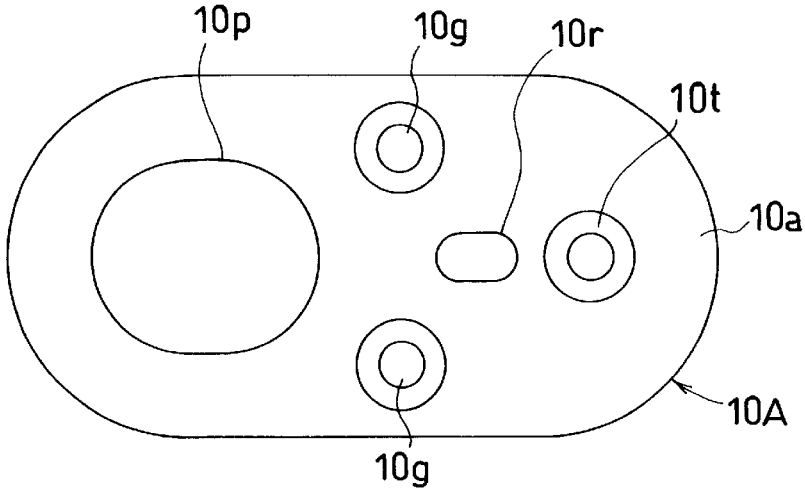
FIGS. 22(A)–(C) indicate the hinge body, (A) being a plan view, (B) a sectional view, and (C) a bottom view.
Figure 22:
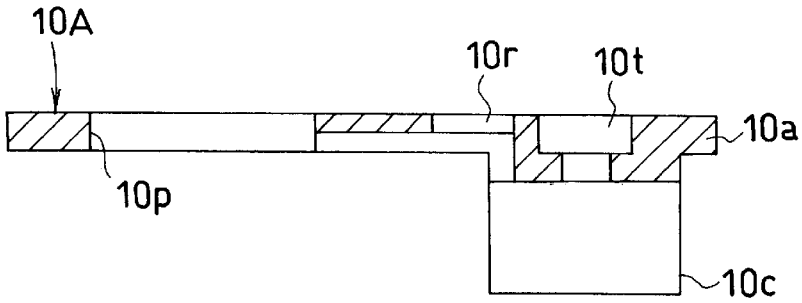
Figure 22:
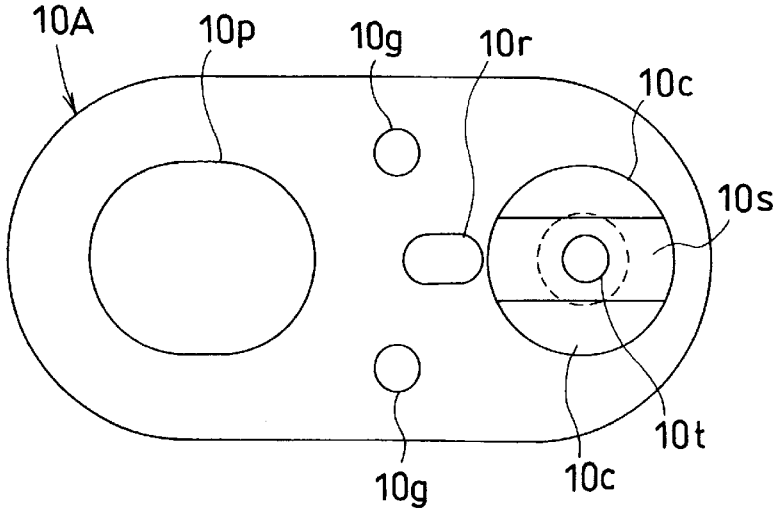
Figure 23:
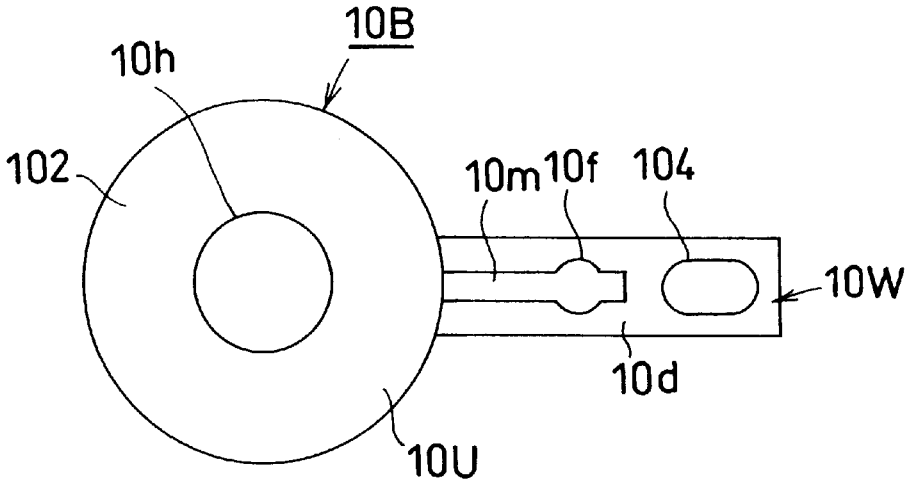
FIGS. 23(A)–(C) indicate a slide base, (A) being a plan view, (B) a sectional view, and (C) a bottom view.
Figure 23:
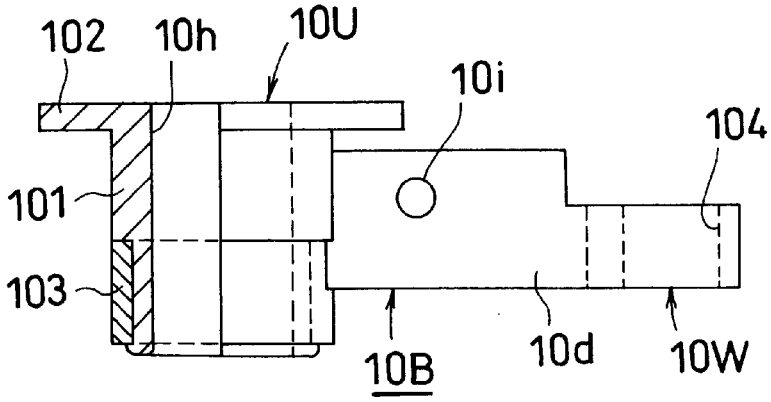
Figure 23:
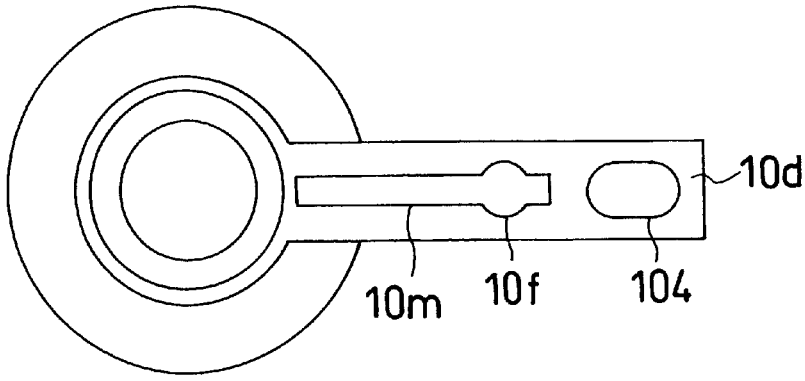

FIG. 21 to FIG. 23 indicate the first modified example of hinge body in the first embodiment of the present invention.

This hinge includes, in the same way as the hinge of the first embodiment and second embodiment, the hinge body unit B to be buried flush with the top and bottom lines on the fixed end of the door D and used together with a hinge spindle unit A in which is disposed the spindle 2 so as to protrude and retract, and the hinge body unit B is buried at a position facing the hinge spindle unit A of the open frame K. The hinge body unit B can adjust the position of the spindle insertion hole 10*h* in which to insert the protruding spindle 2 easily, to enable the door D to be mounted accurately in the open frame K. In this case, the hinge body unit B is composed of a hinge body 10A to be buried and fixed at a position facing the hinge spindle unit A of the open frame K, and a slide base 10B, disposed slidably against this hinge body 10A and forming a spindle insertion hole 10*h* so as to be fixed at any desired position on the hinge body 10A.

The hinge body 10A includes a mounting collar 10*a* to be buried in the open frame K and fixed by screws and a barrel 10*c* formed integrally on a back face side of the mounting collar 10*a*. Set screw holes 10*g*, 10*g*, an adjusting hole 10*r* and a metal insertion hole 10*p* are formed in the mounting collar 10*a*, as shown in FIGS. 21(A)–(C) and FIGS. 22(A)–(C).

This barrel 10*c* has a slit groove 10*s* formed therein, the slit groove 10*s* being open at a bottom face and unrotatably supporting a cam supporting element 10*d* and a nut N inserted there. A bolt insertion hole 10*t* is formed in the slit groove 10*s* to be different in diameter at its top and at its bottom.

The metal insertion hole 10*p*, the adjusting hole 10*r* and the slit groove 10*s* will be formed along one same straight line. Moreover, the metal insertion hole 10*p* and the adjusting hole 10*r* are formed in the shape of a slit, respectively, so that the slide base 10B may be moved for adjustment against the hinge body 10A.

The slide base 10B is composed of a metal 10U in the shape of a short collared pipe, and a slider 10W, as shown in FIG. 21 and FIG. 23. The metal 10U, which forms a spindle insertion hole 10*h* in a barrel 101 in the shape of a short pipe and integrally forms a collar 102 on the outer circumference at the edge, is integrated with the slider 10W so that the barrel 101 may be inserted in the metal insertion hole 10*p* of the hinge body 10A so as to be slidably adjusted in the longitudinal direction of the metal insertion hole 10*p*.

This slider 10W integrally forms a metal holder 103 in the shape of a short pipe at one end of the cam supporting element 10*d*, and the barrel 101 of the metal 10U is inserted in the metal holder 103 and caulked at its end, to fix the metal 10U. Furthermore, the cam supporting element 10*d* of the slider 10W, the width and length of which are determined so as to be slidably inserted in the slit groove 10*s*, forms a groove 10*m* in which the cam 11 (see FIG. 7) is slidably inserted.

In the cam supporting element 10*d* having the groove 10*m*, a shaft hole 10*i* is formed for slidably supporting the cam 11, while a cam push hole 10*f* is formed in part of the groove 10*m*. Further, in the cam supporting element 10*d*, an adjusting set hole 104 is formed in the shape of a slit, so that the slide base 10B may be fixed at any desired position of the hinge body 10A, as a fastening screw 105 inserted in the bolt insertion hole 10*t* passes through this adjusting set hole 104 and is engaged with the nut N.

Assembly of the slide base 10B is realized by fastening the metal 10U to the metal holder 103 of the slider 10W, and the hinge body 10A, attaching the slider 10W from the back side of the hinge body 10A, fitting the cam supporting element 10*d* in the slit groove 10*s*, inserting the metal 10U from the surface side in the metal insertion hole 10*p* and the metal holder 103, and caulking the tip of the barrel 101 of the metal 10U, thereby integrating the metal 10U with the slider 10W. This makes it possible for the slide base 10B to slide in the metal insertion hole 10*p* in the shape of a slit, against the hinge body 10A.

Further, by tightening the nut N, after adjusting the position of the spindle insertion hole 10*h*, and fixing the slide base 10B to the hinge body 10A, it becomes possible to mount the door D in the open frame K accurately. In addition, the cam 11 is slidably mounted in the groove 10*m* of the slide base 10B by means of a shaft 12 inserted in the shaft hole 10*i*, but its action is the same as that of the hinge of the first embodiment.

FIG. 24 to FIG. 29 indicate a second modified example of hinge body in the first embodiment of the present invention.

This second modified example of hinge body is buried, as shown in the first embodiment, at a position facing the hinge spindle unit A of the open frame K, and easy adjustment of the position of the spindle insertion hole in which to insert the protruding spindle 2, to thereby enable the door D to be mounted in the open frame K accurately and so as to keep a uniform clearance at the outer circumference of the door D.

In this case, the hinge body unit B is composed of a hinge body 10A, to be buried in the open frame K, a body cover 10F, attached to the back side of this hinge body 10A and assembled so as to be integrated with the hinge body 10A by caulking, etc., a slide base 10B, slidably inserted between the hinge body 10A and the body cover 10F and enabling adjustment of the spindle insertion hole position, a metal 10E inserted in the spindle insertion hole of the slide base 10B, an adjusting cam 10D for adjusting the movement of the slide base 10B, and a spring 125.

As shown in FIG. 24 and FIGS. 25(A)–(C), the hinge body 10A, buried in the open frame K, is perforated to provide a cam insertion hole 111 in which to insert part of the adjusting cam 10D in a rotatable fashion, a metal adjusting hole 112 in an oval shape, and a mounting hole 113 in which to insert a fastening screw, etc. at about a central part of the hinge body 10A. On the back face side of the hinge body 10A a depression 115 in the shape of a counterbore is formed at the peripheral position of the cam insertion hole 111, fastening claws 116, 116 are formed in a convex shape at regular intervals along an inner circumferential direction of the depression 115, at four positions at 90 degree intervals as illustrated, for example, and further, at both ends in the longitudinal direction on the back face of the hinge body 10A, fastening projections 117, 117 are formed as projections for positioning and fastening the body cover 10F.

Moreover, the depression 115 in the shape of a counterbore is a round depression enabling the disc-shaped collar element of the adjusting cam 10D to be inserted inside, with a depth preferably about equal to the thickness of the disc-shaped collar element of adjusting cam 10D. Furthermore, the metal adjusting hole 112 is a slit, and its length is determined such that the spindle inserting position is adjustable in the direction of breadth of the door D.

Figure 26:
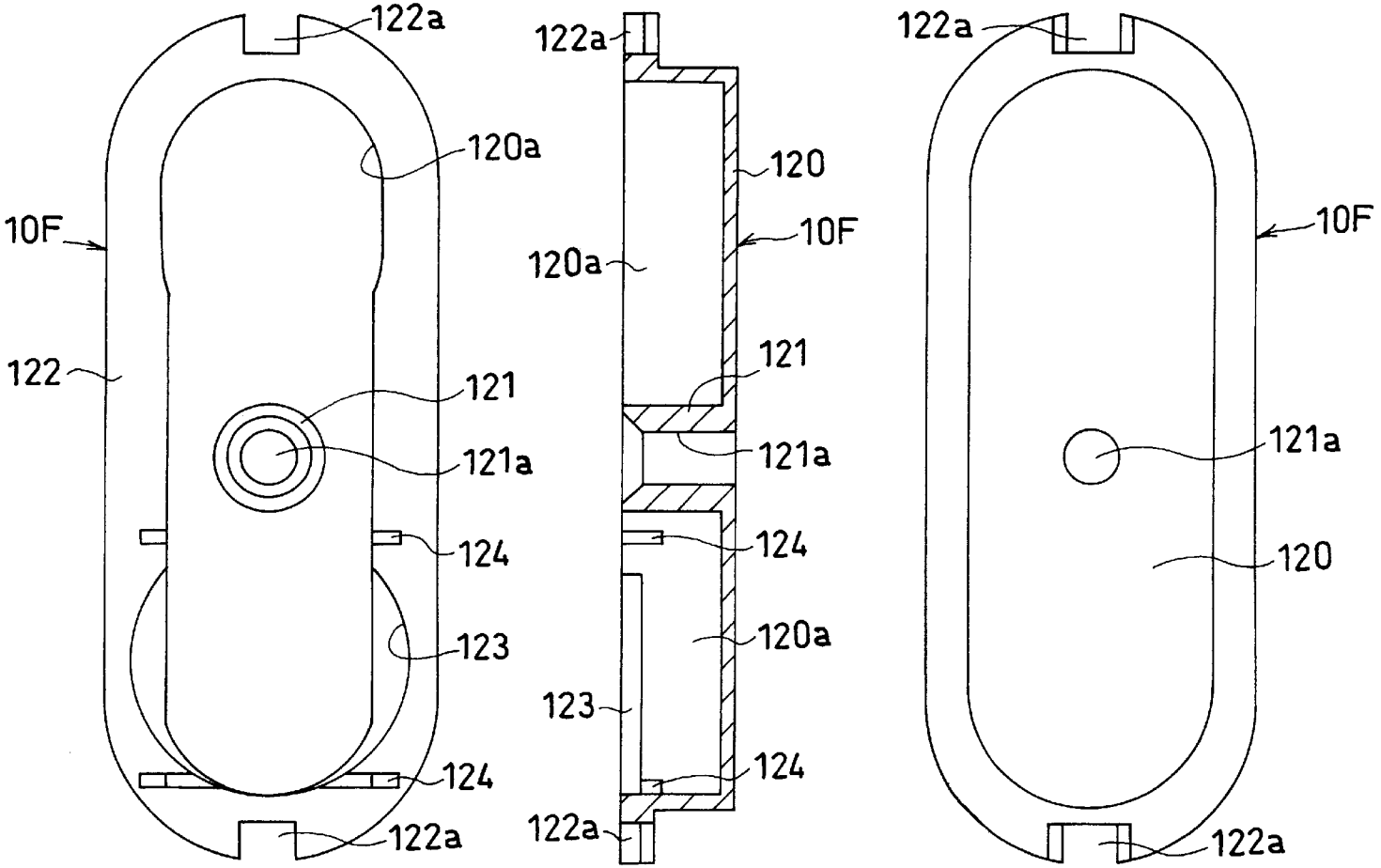
FIGS. 26(A)–(C) indicate a the body cover, (A) being a plan view, (B) a sectional view, and (C) a bottom view.
Figure 27:
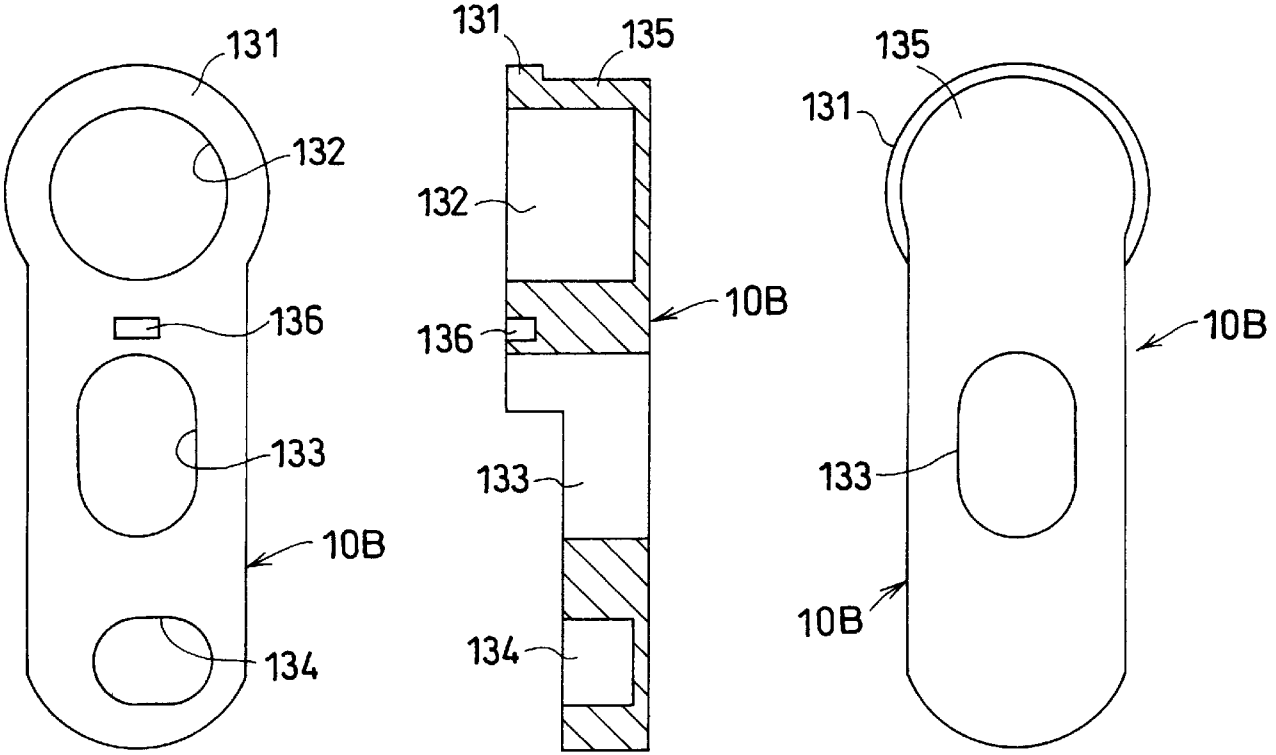
FIGS. 27(A)–(C) indicate a slide base, (A) being a plan view, (B) a sectional view, and (C) a bottom view.
Figure 28:
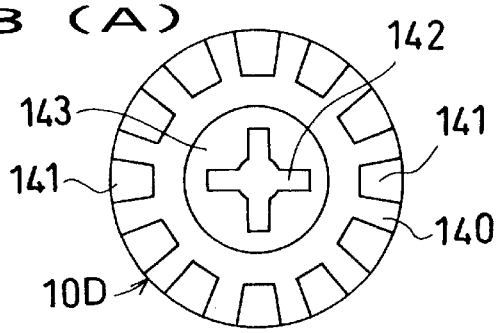
FIGS. 28(A)–(C) indicate an adjusting cam, (A) being a plan view, (B) a front elevation, and (C) a bottom view.
Figure 28:
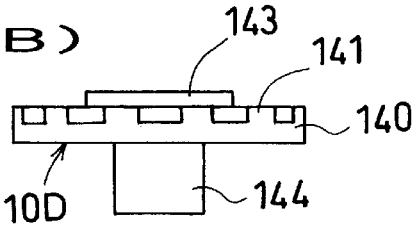
Figure 28:
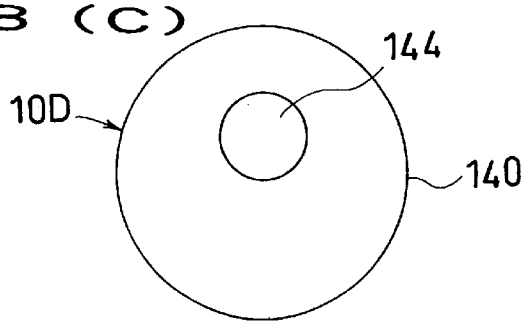
Figure 29:
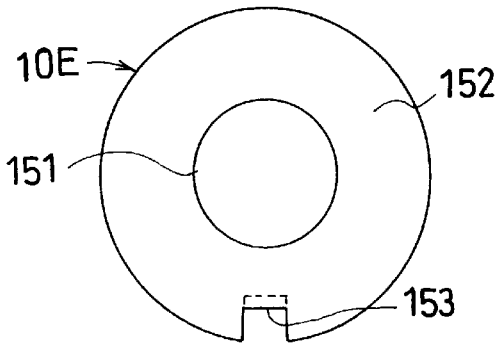
FIGS. 29(A) and (B) indicate a metal, (A) being a plan view, and (B) a front elevation.
Figure 29:
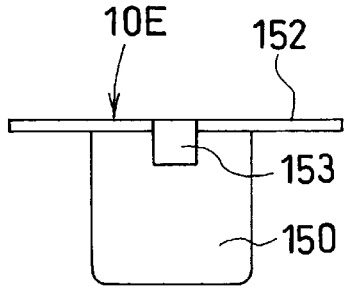

The body cover 10F integrated with the hinge body 10A along the back face side of the latter has an oval shape about equal to the shape of the hinge body 10A, integrally forms a box 120 swelling on one side face, a boss 121 in projection having a set screw hole 121*a* perforated at about a center position of a depression 120*a* of the box 120, a peripheral collar 122 along the outer circumference of the box 120, and, at both ends in the longitudinal direction of the peripheral collar 122, notches 122*a*, 122*a* to be engaged with the fastening projections 117, 117 of the hinge body 10A for integrally fixing the body cover 10F with the hinge body 10A by caulking, etc., as shown in FIG. 26.

Still further, on the body cover 10F will be formed a shallow depression 123, at one end side of the depression 120*a* of the oval box 120. In this shallow depression 123 two spring insertion grooves 124, 124 are formed in parallel to the tangential direction of the shallow depression 123, in which the adjusting cam 10D is inserted, and more specifically the disc-shaped collar 140 of the adjusting cam 10D, depressible against a spring. In these spring insertion grooves 124, 124 will be inserted bar-shaped springs 125, 125 made of piano wire, etc., respectively, so as to support the back face side of the disc-shaped collar 140 of the adjusting cam 10D, and press it to the inner surface side of the shallow depression 123.

The slide base 10B will be formed in an oval shape so as to be slidably inserted in the oval-shaped box 120 of the body cover 10F, as shown in FIG. 24 and FIGS. 27(A)–(C). In the body 130 of this slide base 10B will be formed, inside the metal insertion barrel 135 formed at one end, a metal insertion hole 132 with a capped end, a collar 131 at outer circumference of the metal insertion barrel 135, a slit 133 provided at the center along the direction of slit of the body 130, and a slit 134 at the other end in the direction orthogonal to the longitudinal direction of the body 130. This will make it possible for the slide base 10B to slide, in the body cover 10F along the longitudinal direction thereof, by an amount equal to the amount of eccentricity in the longitudinal direction while retracting the amount of eccentricity in the transversal direction of the adjusting cam 10D, when the eccentric shaft of the adjusting cam 10D is inserted in the slit 134 and turn off center of the adjusting cam 10D with the rotation of the adjusting cam 10D.

The adjusting cam 10D will form a disc-shaped operating element 143 in projection, at the central part on one end side of the disc-shaped collar 140 and in a diameter smaller than that of the disc-shaped element, so as to be rotatably inserted in the cam insertion hole 111 on the hinge body 10A side. The adjusting cam 10D will also form, on the surface side of this disc-shaped collar 140 constituting the body unit of the adjusting cam D, fastening claws 141, 141 disposed alternately in concavity and convexity at predetermined intervals or angles along the circumferential direction so as to be engaged with either one of the fastening claws 116 on the hinge body side. The adjusting cam 10*d* will further form a rotatable fastening groove 142 for fastening and turning a Phillips screwdriver, etc. inside the operating element 143, and also form, on the back face side of disc-shaped collar 140, an eccentric shaft 144 in projection with an eccentricity of a predetermined distance against the center of the disc-shaped collar 140, as shown in FIG. 24 and FIGS. 28(A)–(C).

This will make it possible for the slide base 10B, in which is inserted the eccentric shaft 144, to move in the body cover 10F along the longitudinal direction thereof, according to the amount of eccentricity of the eccentric shaft 144, when the adjusting cam 10D rotates.

In addition, the adjusting cam 10D is supported by the springs 125, 125 inserted in the spring insertion groove 124 and pressed by spring pressure toward the hinge body side, when it is inserted in the box 120 of the body cover 10F, at both ends on the back face of the disc-shaped collar 140 of the adjusting cam 10D, and is rotatable in either the clockwise or counterclockwise directions of the adjusting cam 10D, by loosening the springs 125, 125 and releasing the fastening between the fastening claws 116 and 141, when the adjusting cam 10D is further pressed so as to be pushed into the body cover.

Figure 24:
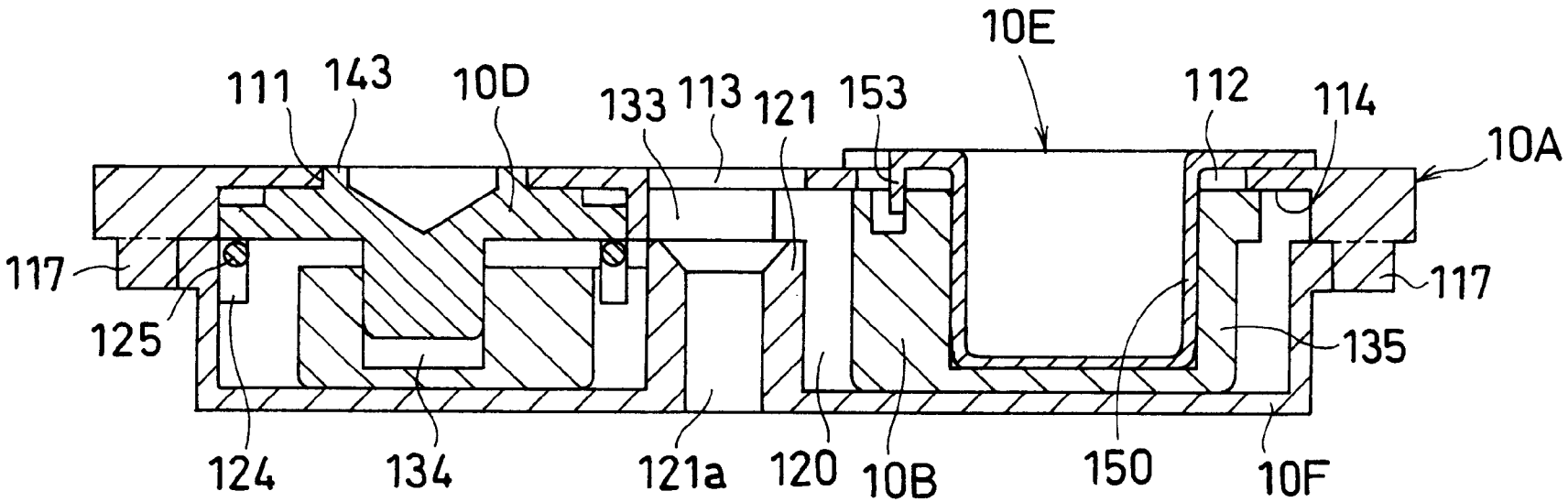
FIG. 24 is a sectional view showing a second modified example of the hinge body unit of the second embodiment of the present invention.
Figure 25:
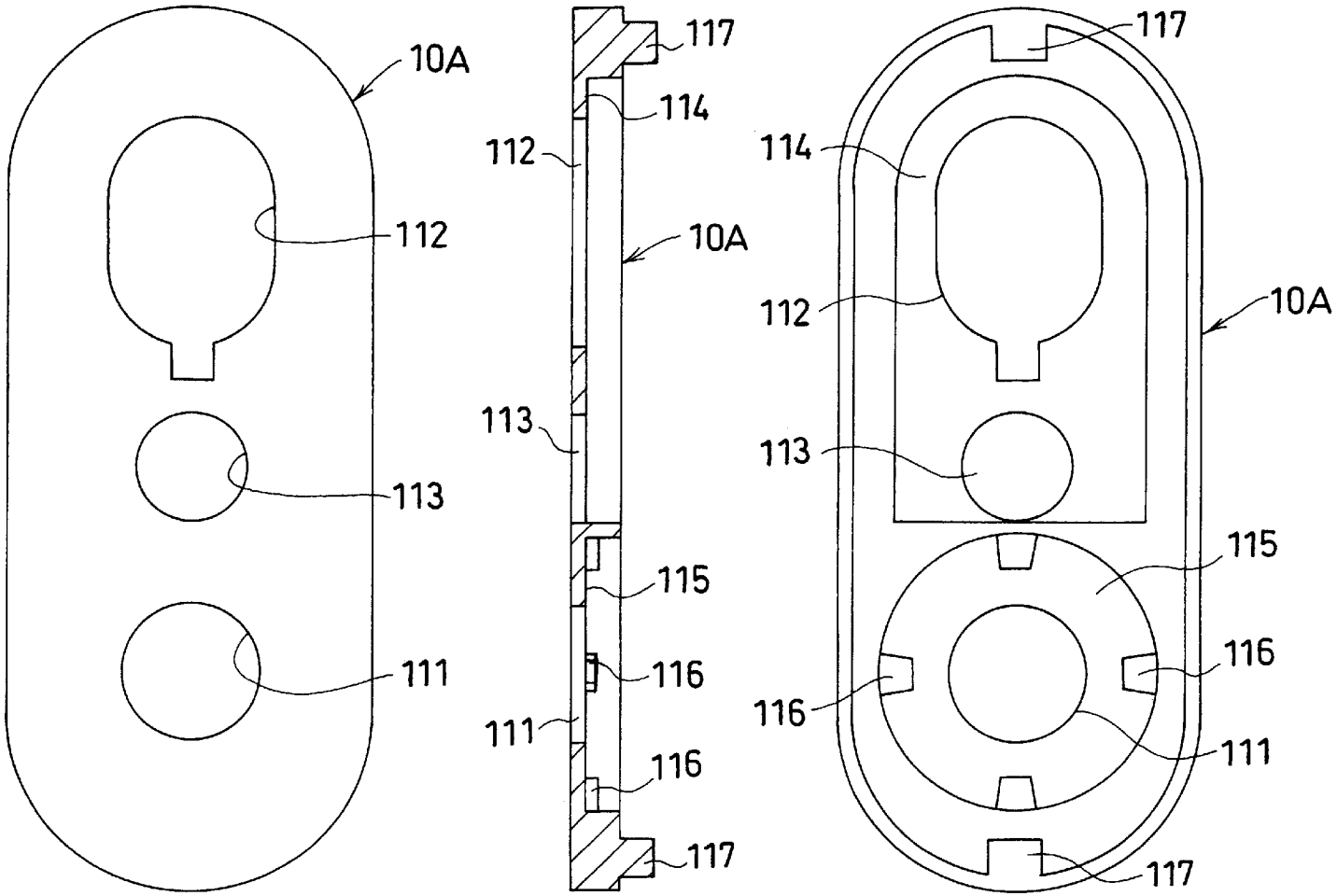
FIGS. 25(A)–(C) indicate a hinge body, (A) being a plan view, (B) a sectional view, and (C) a bottom view.

The metal 10E will form, inside a cylinder-shaped spindle insertion barrel 150 enabling insertion of the spindle 2, a spindle insertion hole 151, integrally form a collar 152 on one end face side of this spindle insertion hole 150, and also form a tongue-shape fastening element 153 with a notching part of the collar 152, as shown in FIG. 24 and FIGS. 29(A) and (B), to thereby be fastened to a fastening groove 136 formed in the metal insertion barrel 135, for protection against turning of the metal 10E.

The assembly of the second modified example of the hinge body unit in this first embodiment will be explained below.

First, the slide base 10B is mounted in the box 120 of the body cover 10F. The springs 125, 125 are inserted in the spring insertion holes 124, 124 respectively, and then place the adjusting cam 10D is placed on the slide base 10B by inserting the eccentric shaft 144 in the slit 134 of this slide base 10B. Next, the hinge body 10A is disposed so as to cover over this body cover 10F. At this time, the disc-shaped collar 140 of the adjusting cam 10D is inserted in the shallow depression 123 of the body cover 10F, and the operating element 143 is inserted in the cam insertion hole 111. Next, the hinge body 10A and the body cover 10F are integrated by caulking either one of the fastening projection 117 or the peripheral collar 122 provided with the notch 122*a*. The hinge body unit B is assembled by inserting the metal 10E in the metal insertion hole 132 from the outside of the hinge body 10A through the metal adjusting hole 112, and fixing it there.

In this second modified example of hinge body unit in the first embodiment, the adjusting cam 10D is turned in the clockwise direction by means of a screwdriver, etc., when adjusting the spindle 2 inserting position along the direction of breadth of the door D. In this case, it is necessary to release the fastening between the fastening claw 141 of the adjusting cam 10D and the fastening claw 116 of the hinge body, because these fastening claws 141, 116 are mutually fastened and unrotatable. Therefore, to release the fastening between these fastening claws 141, 116, press the adjusting cam 10D is pressed so as to push it into the body cover, the spring 125 will be loosened, the adjusting cam 10D will be pushed into the body cover, and the fastening between these fastening claws 141, 116 will be released to enable the adjusting cam 10D to turn freely, thus making it possible to perform adjustment by turning the adjusting cam 10D in either the clockwise or counterclockwise directions.

The fastening claw 116 formed on the hinge body 10A and the fastening claw 141 formed on the adjusting cam 10D may also be sawtooth shaped. In this case, the fastening claws 141, 116 act as unidirectional clutches, and the adjusting cam 10D turns in the clockwise direction only and is unable to turn in the counterclockwise direction because the fastening claws 141, 116 are fastened to each other. For turning in the counterclockwise direction, the adjusting cam 10D is pressed so as to be pushed into the body cover, the spring 125 will be loosened, the adjusting cam 10D will be pushed into the body cover, and the fastening between the fastening claws 141, 116 will be released to enable the adjusting cam 10D to turn freely, thus making it possible to perform adjustment by turning the adjusting cam 10D in the counterclockwise direction in this state.

The hinge according to the present invention has so far be explained based on a plurality of embodiments and their modified examples. However, the present invention is not restricted to the constructions described in the embodiments, but its construction may be modified as required within the range not deviated from its purpose, by such means as combining the constructions described in the respective embodiments and their modified examples as required, etc.

Figure 30:
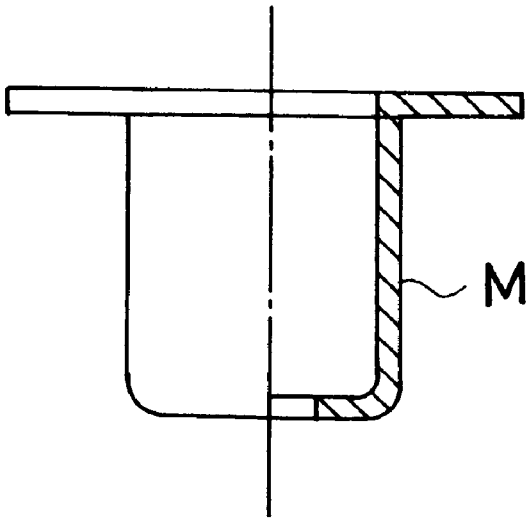
FIG. 30 indicates a metal of simple construction used for the present invention, (A) being a partially broken front elevation, and (B) a plan view.
Figure 30:
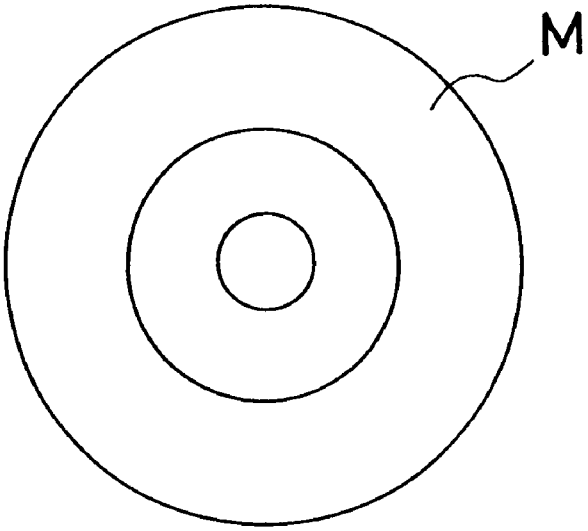

Moreover, the hinge body may be used in the form of the embodiments for both the top and the bottom parts of the door. It is also possible to adopt one of the embodiments for the open frame K at the bottom and adopt a metal M of simple construction that simply fits a spindle, as shown in FIGS. 30(A) and (B), for the open frame K at the top. In this case, the adjustment of mounting of the door will be made at the hinge body unit installed on the open frame side at the bottom.

What is claimed is:

1. A hinge comprising:

a hinge spindle unit to be buried flush with one of a top line and a bottom line of a fixed end of a door, said hinge spindle unit having a spindle adapted to protrude and retract from said hinge spindle unit; and a hinge body unit to be buried in an open frame at a position facing said hinge spindle unit, said hinge body unit comprising a hinge body having a boss adapted to receive said spindle when said spindle protrudes from said hinge spindle unit such that the door can be opened and closed, and a cam swingably supported in said hinge body, said cam being operable to retract said spindle.

2. A hinge according to claim 1, wherein said hinge spindle unit comprises a spindle case body having a spring adapted to bias said spindle to protrude from said spindle case body, and a stopper being operable to hold said spindle in a retracted state within said spindle case body.

3. A hinge according to claim 1, wherein said spindle has a rack gear and said hinge spindle unit comprises a spindle case body having a pinion meshing with said rack gear to protrude and retract said spindle by turning said pinion, and a stopper being operable to hold said spindle in a prescribed position.

4. A hinge according to claim 1, wherein said hinge body unit further comprises a hinge body to be buried and fixed at a position to face said hinge spindle unit, and a slide base having a spindle insertion hole disposed slidably against said hinge body so as to be adjustable on said hinge body.

5. A hinge according to claim 2, wherein said hinge body unit further comprises a hinge body to be buried and fixed at a position to face said hinge spindle unit, and a slide base having a spindle insertion hole disposed slidably against said hinge body so as to be adjustable on said hinge body.

6. A hinge according to claim 3, wherein said hinge body unit further comprises a hinge body to be buried and fixed at a position to face said hinge spindle unit, and a slide base having a spindle insertion hole disposed slidably against said hinge body so as to be adjustable on said hinge body.

7. A hinge according to claim 2, wherein said spindle case body has a guide groove and said spindle has a guide slidable within said guide groove, said guide groove preventing said spindle from being completely removed from said hinge spindle unit.

8. A hinge according to claim 3, wherein said spindle case body has a guide groove and said spindle has a guide slidable within said guide groove, said guide groove preventing said spindle from being completely removed from said hinge spindle unit.

9. A combination comprising:

a door;

an open frame; and a hinge comprising:

a hinge spindle unit buried flush with one of a top line and a bottom line of a fixed end of said door, said hinge spindle unit having a spindle adapted to protrude and retract from said hinge spindle unit; and a hinge body unit buried in said open frame at a position facing said hinge spindle unit, said hinge body unit comprising a hinge body having a boss adapted to receive said spindle when said spindle protrudes from said hinge spindle unit such that said door can be opened and closed, and a cam swingably supported in said hinge body, said cam being operable to retract said spindle.

10. A combination according to claim 9, wherein said hinge spindle unit comprises a spindle case body having a spring adapted to bias said spindle to protrude from said spindle case body, and a stopper being operable to hold said spindle in a retracted state within said spindle case body.

11. A combination according to claim 9, wherein said spindle has a rack gear and said hinge spindle unit comprises a spindle case body having a pinion meshing with said rack gear to protrude and retract said spindle by turning said pinion, and a stopper being operable to hold said spindle in a prescribed position.

12. A combination according to claim 9, wherein said hinge body unit further comprises a hinge body buried and fixed at a position to face said hinge spindle unit, and a slide base having a spindle insertion hole disposed slidably against said hinge body so as to be adjustable on said hinge body.

13. A combination according to claim 10, wherein said hinge body unit further comprises a hinge body buried and fixed at a position to face said hinge spindle unit, and a slide base having a spindle insertion hole disposed slidably against said hinge body so as to be adjustable on said hinge body.

14. A combination according to claim 11, wherein said hinge body unit further comprises a hinge body buried and fixed at a position to face said hinge spindle unit, and a slide base having a spindle insertion hole disposed slidably against said hinge body so as to be adjustable on said hinge body.

15. A combination according to claim 10, wherein said spindle case body has a guide groove and said spindle has a guide slidable within said guide groove, said guide groove preventing said spindle from being completely removed from said hinge spindle unit.

16. A combination according to claim 11, wherein said spindle case body has a guide groove and said spindle has a guide slidable within said guide groove, said guide groove preventing said spindle from being completely removed from said hinge spindle unit.

* * * * *